United States Patent [19]

Nakamura et al.

[11] Patent Number: 4,603,849

[45] Date of Patent: Aug. 5, 1986

[54] PAPER-SHEET DIVIDING APPARATUS

[75] Inventors: Kunihiko Nakamura; Takashi Koshiyouji, both of Yokohama, Japan

[73] Assignee: Tokyo Shibaura Denki Kabushiki Kaisha, Kawasaki, Japan

[21] Appl. No.: 526,137

[22] Filed: Aug. 24, 1983

[30] Foreign Application Priority Data

Sep. 3, 1982 [JP] Japan ..... 57-152552

[51] Int. Cl.[4] ..... B65H 29/40; B65H 31/32; B65H 33/16

[52] U.S. Cl. ..... 271/186; 271/187; 271/218; 271/315

[58] Field of Search ..... 271/187, 218, 315, 189, 271/190, 191, 192, 178, 65, 82

[56] References Cited

U.S. PATENT DOCUMENTS 4,470,590 9/1984 Ariga et al. ..... 271/187

FOREIGN PATENT DOCUMENTS 1079078 4/1960 Fed. Rep. of Germany .
0141354 9/1982 Japan ..... 271/187
2059391 4/1981 United Kingdom ..... 271/315
2085849 5/1982 United Kingdom .

*Primary Examiner*—Bruce H. Stoner, Jr.
*Assistant Examiner*—Lawrence J. Goffney, Jr.
*Attorney, Agent, or Firm*—Oblon, Fisher, Spivak, McClelland & Maier

[57] ABSTRACT

A paper-sheet dividing apparatus has a blade wheel which has a plurality of curved slots. Each curved slot is rotated to sequentially deliver a paper sheet to a conveyor belt. The apparatus also has a dividing member rotated together with the blade wheel and timed such that a corresponding curved slot for receiving the last paper sheet among the first predetermined number of paper sheets to be divided is axially matched with one of the first blades which is positioned between the curved slot which receives the first paper sheet among the second predetermined number of paper sheets and the curved slot which receives the last paper sheet described above. The dividing member is rotated through a predetermined angle and is separated from the blade wheel. During this movement, the paper sheet removed from the blade wheel is temporarily supported on the dividing member. Therefore, the paper sheets previously removed from the blade wheel and piled on the conveyor belt can be transferred without interrupting the operation of the blade wheel. After transfer of the previously removed paper sheets, the paper sheets on the dividing member can be transferred to the conveyor belt.

16 Claims, 20 Drawing Figures

PAPER-SHEET DIVIDING APPARATUS

BACKGROUND OF THE INVENTION

This invention relates to a paper-sheet dividing apparatus for dividing into stacks, each having a fixed number of paper sheets that are supplied one by one by a conveying path, and transferring the stacks successively to a predetermined position.

Heretofore, apparatus for handling paper sheets, for example, bank notes, data cards and various printed matter have been in practical use. In recent years, demand for a high-speed paper-sheet dividing apparatus has steadily increased.

For example, bank notes are divided into paper sheet stacks having a fixed number of paper sheets. Each stack is bundled with a suitable belt and then kept in storage. As it is inefficient to divide the paper sheets manually into stacks, an automatically operated dividing apparatus is usually used to divide the bank notes into stacks and to bundle them. In such an apparatus, paper sheets supplied one by one can be stacked without stopping the supply of the paper sheets. It is considered that the desired dividing apparatus can continuously pile the paper sheets supplied one by one without interruption, and while the paper sheets are piled as described above, the paper sheets are divided into groups each including a fixed number of paper sheets.

In order to provide a dividing apparatus as described above, a conventional method for changing the travelling direction of paper sheets, called a beat method, has been adopted, wherein each of the paper sheets supplied at a high speed is thrown from the end of the conveying path. The floating paper sheet is then struck by a reciprocal member and dropped to a pile at a predetermined stacking position. The travelling direction changing means has a limited high-speed response, i.e., when the reciprocal member is driven at high speed and with a constant amplitude, the inertial force of the reciprocal member, and consequently the force applied to the travelling direction changing means, is increased. As a result, since operation of the apparatus becomes unstable and the paper sheets are often piled in a bent or disrupted state, it becomes necessary to strengthen the structure of the apparatus increasing the cost.

Accordingly, an apparatus using the beat method is not suitable for high speed operation. In order to eliminate the above-mentioned disadvantages, an apparatus having a blade wheel has been developed. The blade wheel has a plurality of blades extending in the same direction from the vicinity of a shaft of the blade wheel to its periphery. Between every adjacent two blades a space or slot is formed, and each paper sheet supplied from the end of the conveying path is inserted in the slot. The paper sheets in the slots are delivered therefrom and piled in a predetermined position of a transfer means to make stacks each having a fixed number of paper sheets.

Now, assume the number of paper sheets supplied per minute to the blade wheel is N, the period at which successive two paper sheets are supplied is t second, the number of slots formed in the blade wheel is m, the angle between two adjacent blades is $\alpha$ degree and the rotating speed at which the blade must rotate is n.

Then t, $\alpha$ and n is expressed as follows.

$$t = 60/N \text{ sec}$$

-continued $$\alpha = 360/m \text{ deg.} = 1/m \text{ revolution}$$

$$n = \frac{1}{m} / \frac{60}{N} = \frac{1}{60} \cdot \frac{N}{m} \text{ rps} = N/m \text{ rpm}$$

For example, when N=1,800 and m=18, then n is 100. This example shows that even if the paper sheets are supplied at a high speed of 1,800 per minute, the blade wheel rotating at a relatively low speed of 100 rpm is able to receive the paper sheets and discharge them at a predetermined position to make a stack.

Heretofore, means for dividing the paper sheets is provided to cooperate with the blade wheel which is effective for dividing the paper sheets into groups containing a fixed number of paper sheets without interrupting the supply of paper sheets. The dividing means is rotated at a higher speed than the blade wheel through a space defined between an end of the conveying means of the paper sheets and the blade wheel. The moving of the dividing means is carried out in the dead time in which a gap of the adjacent two paper sheets passes through the space. Then the dividing means temporarily receives the paper sheets discharged from the blade wheel and delivers them onto a stacking means. The delivering of the paper sheets supported on the dividing member is carried out after the stack of paper sheets which is previously made on the stacking means is transferred to a predetermined position.

When the paper sheets are supplied at high speed, the dead time becomes short and the speed of the dividing means passing the space between the end of the conveying means and the blade wheel must be high. Thus the operation of the dividing means becomes unstable, paper sheets to be supplied to the blade wheel are often blocked and/or jammed by a large inertial force caused by the high speed movement of the dividing means. Furthermore, force applied to the mechanical parts of the paper-sheet dividing apparatus due to inertia is increased and a powerful driving means for the mechanical parts is required resulting in large size and high cost. As mentioned above, even if stacking means with the blade wheel is suited for high speed piling operation, the dividing means to be combined with the stacking means is not suitable for high speed operation. Therefore the apparatus including the stacking means and dividing means as described above is not suitable for high speed operation.

SUMMARY OF THE INVENTION

An object of the present invention is to provide a paper-sheet dividing apparatus for dividing paper sheets, which are supplied one by one at a high speed, and piling them to make stacks of a fixed number.

To achieve this object, the apparatus of this invention comprises a blade wheel having a rotating shaft and a plurality of first blades each extending outward from near the rotating shaft; inserting means for putting each of the paper sheets into a space formed between two adjacent first blades; means for discharging the paper sheets each inserted in the slot; stacking means for piling the paper sheets discharged from the spaces; a second blade having substantially the same shape as that of the first blade; supporting means for rotatably supporting the second blade which is substantially coaxial with the first blade; means for rotating the second blade at the same rotating speed as that of the first blade from a stop position to a dividing position and thereafter moving the second blade away from the rotating shaft of the blade wheel.

According to the paper-sheet dividing apparatus of this invention, the second blade having a paper sheet receiving surface substantially the same shape as that of the paper sheet receiving surface of the first blade is rotated to divide the paper sheets into groups having a fixed number of paper sheets. The second blade is rotated at substantially the same rotating speed as that of the first blade of the blade wheel.

As described above, since the second blade rotates together with the blade wheel as if the second blade is a part of the blade wheel, the apparatus is capable of dividing the paper sheets into groups having a fixed number of paper sheets without deterioration of the excellent high speed performance of the blade wheel. In the paper-sheet dividing apparatus of this invention, stacking means and dividing means each having excellent high speed performance are combined.

BRIEF DESCRIPTION OF THE DRAWINGS

FIGS. 7A, 7B, 7C, 7D, 7E, 7F, 7G, 7H, 7I, 7J and 7K are front views for explaining the steps of operation of the apparatus over time;

DETAILED DESCRIPTION OF THE PREFERRED EMBODIMENTS

Figure 1:
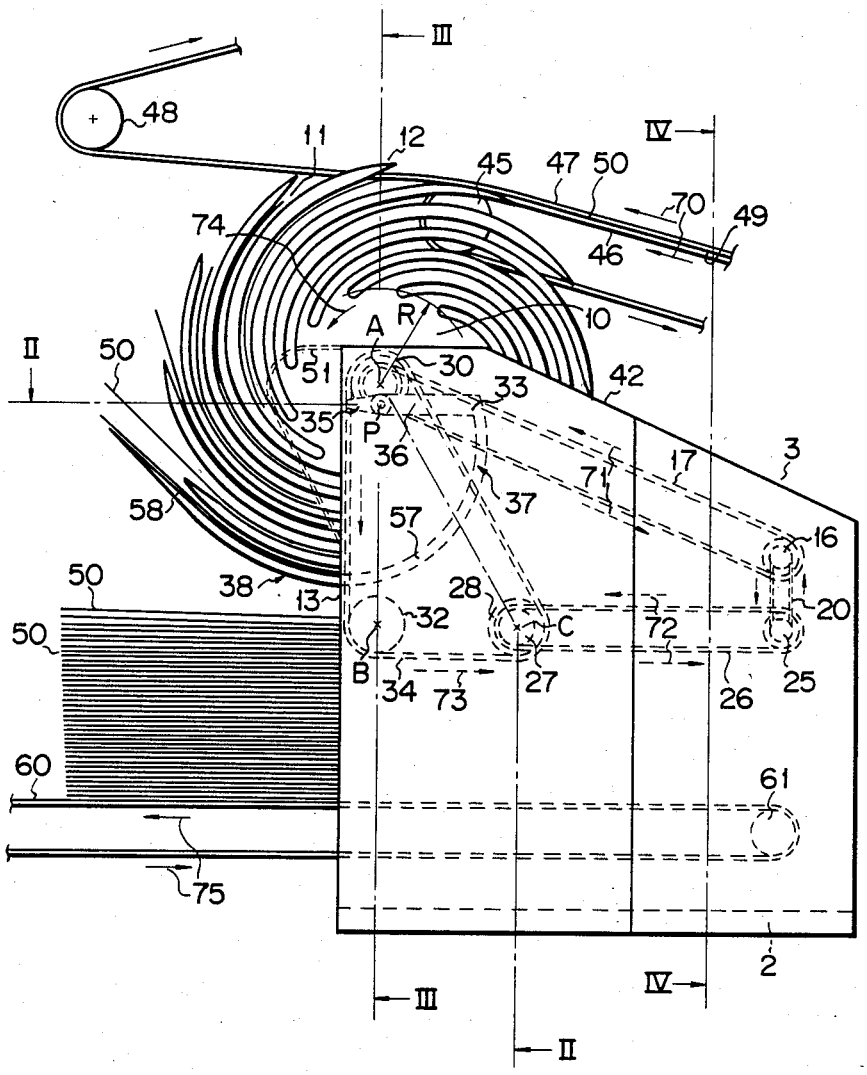
FIG. 1 is a front view of a paper-sheet dividing apparatus according to an embodiment of the present invention.
Figure 2:
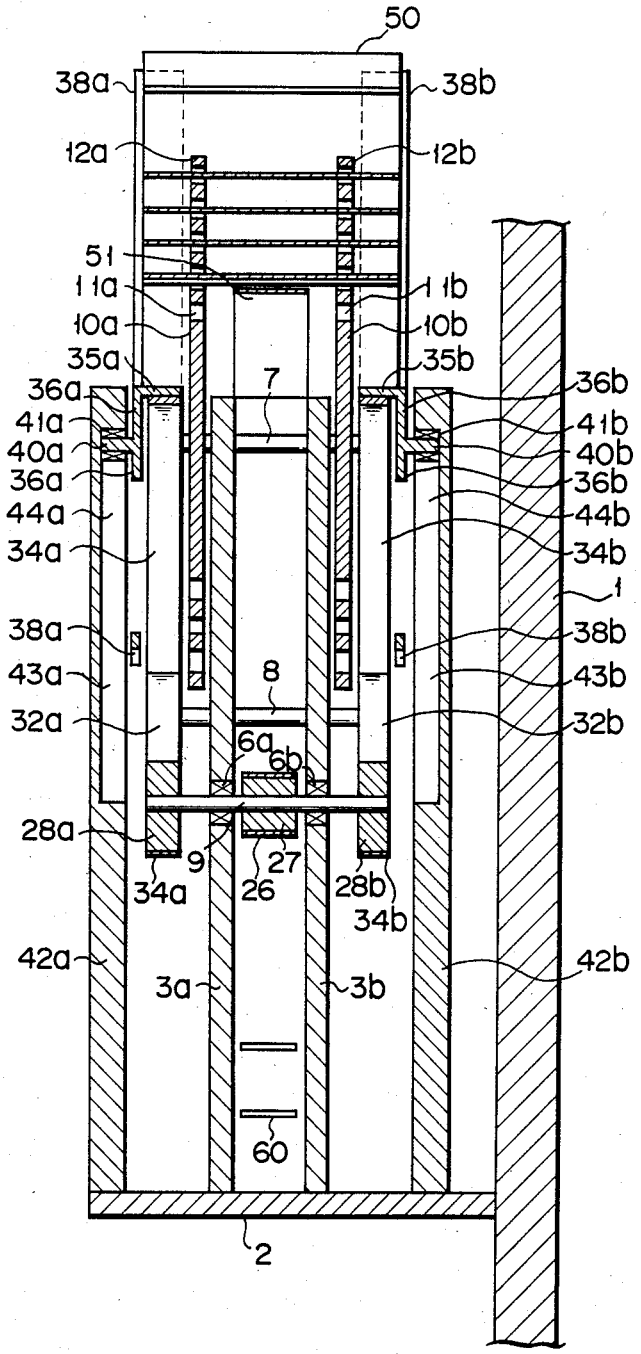
FIG. 2 is a sectional view of the apparatus in FIG. 1 taken along the line II—II and viewed in the direction of the arrow.
Figure 3:
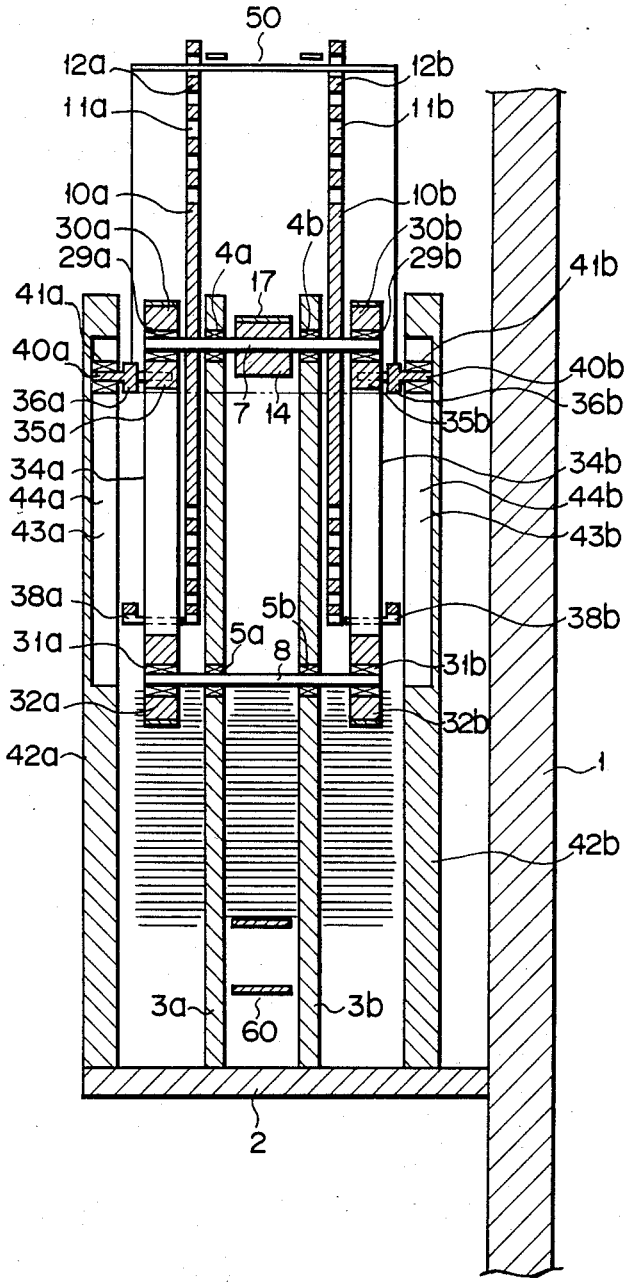
FIG. 3 is a sectional view of the apparatus in FIG. 1 taken along the line III—III and viewed in the direction of the arrow.

A support plate 3 shown in FIG. 1 comprises two support plates 3*a* and 3*b* which are substantially parallel to each other, as shown in FIG. 2. Suffixes a and b of reference numeral 3 are designated to distinguish between the two support plates. When only reference numeral 3 is used, the two support plates need not be distinguished. (Suffixes a and b of any reference numeral used hereinafter have the same function.) The support plates 3*a* and 3*b* are disposed on a fixing plate 2 to be substantially perpendicular thereto at a predetermined interval. The fixing plate 2 is mounted on a base plate 1 to be substantially perpendicular thereto. As shown in FIG. 1, a vertical side wall 13 is disposed at the left-hand side of the support plates 3. Shafts 7, 8 and 9 are rotatably supported at points A, B and C of the upper left portions of the support plates 3 through bearings 4*a* and 4*b*, bearings 5*a* and 5*b*, and bearings 6*a* and 6*b*, respectively, as shown in FIGS. 2 and 3, such that each of the shafts 7, 8 and 9 has two ends which respectively extend through the support plates 3*a* and 3*b* so as to have extending portions of the same length. Axes of the shafts 7, 8 and 9 correspond to points A, B and C, respectively. Points A and B are substantially aligned on a vertical line and the points B and C are substantially aligned on a horizontal line, as shown in FIG. 1. Therefore, points A, B and C constitute a right-angled triangle ABC. The vertices of triangle ABC will be described later.

Figure 4:
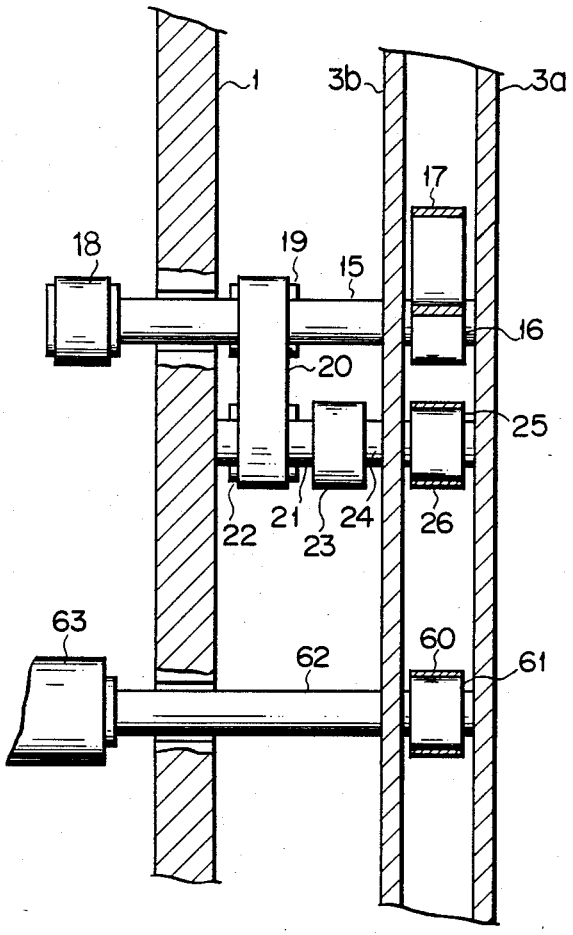
FIG. 4 is a sectional view of the apparatus in FIG. 1 taken along the line IV—IV and viewed in the direction of the arrow.

As shown in FIGS. 2 and 3, blade wheels 10*a* and 10*b* are mounted on the extending portions of the shaft 7 which respectively extend outside the support plates 3*a* and 3*b*. The blade wheels 10*a* and 10*b* rotate counterclockwise in FIG. 1. Point A indicates the axis of the blade wheel 10. The blade wheel 10 has a disc shape as a whole, as shown in FIG. 1. The blade wheel 10 has twelve first blades 12 of an involute curve which have the same shape. The twelve first blades 12 extend outward at equal angular intervals of 30° in a direction opposite to the rotating direction of the wheel from the disc portion having a radius R in the vicinity of the center of the blade wheel. Any two adjacent blades among the blades 12 define a curved space or slot 11 of an involute curve. A paper sheet 50 is intended to be inserted in the corresponding curved slot 11. As shown in FIG. 3, a pulley 14 is mounted on the shaft 7 between the support plates 3*a* and 3*b*. As shown in FIG. 4, a pulley 16 is mounted on a shaft 15 between the support plates 3*a* and 3*b*. The shaft 15 extends through the base plate 1. A transmission belt 17 is looped around the pulleys 14 and 16 (FIGS. 1 and 4). An extending portion (left in FIG. 4) of the shaft 15 which extends outward from the base plate 1 is coupled to a motor 18. The motor 18 is mounted on the base plate 1 through a proper mounting member (not shown). As shown in FIG. 4, a pulley 19 is mounted on a portion of the shaft 15 which is disposed between the base plate 1 and the support plate 3*b*. The pulley 19 is coupled to a pulley 22 through a transmission belt 20. The pulley 22 is mounted on a shaft 21 one end of which is rotatably supported on the base plate 1. A shaft 24 is supported by the support plates 3*a* and 3*b* to be coaxial with the shaft 21. The shafts 21 and 24 are coupled/uncoupled by a clutch mechanism 23 disposed therebetween. A pulley 25 is mounted on a portion of the shaft 24 which is disposed between the support plates 3*a* and 3*b*. A transmission belt 26 (FIGS. 1, 2 and 4) is looped around the pulley 25 and a pulley 27 mounted on the shaft 9. Pulleys 28*a* and 28*b* are mounted at two ends of the shaft 9, as shown in FIG. 2. Pulleys 30*a* and 30*b* which have the same diameters as those of the pulleys 28*a* and 28*b* are mounted at the two ends of the shaft 7 through bearings 29*a* and 29*b*, respectively. Furthermore, as shown in FIG. 3, pulleys 32*a* and 32*b* which have the same diameters as those of the pulleys 28*a*, 28*b*, 30*a* and 30*b* are mounted at the two ends of the shafts 8 through bearings 31*a* and 31*b*, respectively. The axes of the pulleys 28, 30 and 32 correspond to points C, A and B (FIG. 1), respectively. A conveyor belt 34 is looped around the pulleys 28, 30 and 32. As previously described, points A, B and C correspond to vertices of the right-angled triangle ABC, so that the conveyor belt 34 travels in the direction indicated by an arrow 73 along a right-angled triangular path of three lines obtained by connecting three arc portions thereof.

A dividing member 38 is mounted on the conveyor belt 34 and serves to divide the paper sheets 50. As shown in FIGS. 1 and 2, the dividing member 38 comprises: a distal end portion 35 fixed, for example, by a rivet at the outer side of the conveyor belt 34 as shown in FIGS. 1 and 2; an arm 36 which has one end formed integrally with the distal end portion 35 and which extends substantially perpendicular to the travel direction of the part of the conveyor belt 34 along the side surface of the blade wheel 10, this part opposing the position of the distal end portion; and a second blade 37 having a paper sheet supporting surface 37*a* and extending from the other end (i.e., extending end 33) of the arm 36 substantially parallel to the side surface of the first blade 12. When the conveyor belt 34 is driven, the dividing member 38 is moved together with the conveyor belt 34. When the distal end portion 35 of the dividing member 38 is moved along the periphery of the pulley 30, the arm 36 is oriented in a direction toward the point A (i.e., the radial direction of the pulley 30), and the dividing member 38 is rotated about a point P. Point P indicates an axis of the pivotal movement of the dividing member 38. Point P coincides with point A in FIG. 1. When the dividing member 38 is moved together with the conveyor belt 34, and the distal end portion 35 of the dividing member 38 reaches the periphery of the pulley 32, point P coincides with point B in FIG. 1. The dividing member 38 is rotated coaxially with the pulley 32 using point P as a center. However, when the distal end portion 35 moves along the periphery of the pulley 28, point P coincides with point C, so that the dividing member 38 is rotated about point P coaxially with the pulley 28. When the distal end portion 35 is moving on the straight travelling portion of the conveyor belt 34, the dividing member 38 moves parallel to the plane of the triangle ABC while its arm 36 is perpendicular to the straight travelling portion.

A pin 40 is mounted at point P of the arm 36 so as to properly perform the above-mentioned movement of the dividing member 38, as shown in FIG. 3. A bearing 41 is fitted around the pin 40. The bearing 41 is guided along a guide wall 44 formed in a guide recess 43 (FIGS. 2 and 5) which is formed in a guide plate 42. A distance between the extending end 33 of the arm 36 and point P is substantially the same as the radius R of the disc portion which surrounds the axis of the blade wheel 10. The distance between the distal end portion 35 and the axis of the blade wheel 10 is predetermined to be substantially the distance r+d (where r is the radius of the pulley 30 and d is the thickness of the conveyor belt 34). The second blade 37 comprises a proximal portion 57 and an extending portion 58 (FIG. 1). These portions 57 and 58 comprise an involute curve which is the same as that of each of the first blades 12. The proximal portion 57 has substantially the same shape as that of the first blades 12 of the blade wheel 10. The extending portion 58 extends integrally from the proximal portion 57. When the axes of the dividing member 38 and the blade wheel 10 coincide with point A in FIG. 1 and the dividing member 38 and the blade wheel 10 relatively rotate through a suitable angle, the integral formation of the arm 36 and the second blade 37 allows matching of the proximal portion 57 of the dividing member 38 with the first blade 12 of the blade wheel 10 in the axial direction when the position of the sorting member 38 is moved relative to the blade wheel 10. In this case, matching the axial direction means that the first blade 12 is superposed or overlaid on the proximal portion 57 when the blade wheel 10 and the dividing member 38 are viewed in the axial direction. This condition is simply referred to as a matched state of the blade wheel 10 and the dividing member 38 in the axial direction. The conveyor belt 34 and the blade wheel 10 are driven by the single motor 18, so that they are driven at the same rotational speed. Therefore, when the dividing member 38 is coaxially rotated together with the blade wheel 10, the dividing member 38 can be rotated while matched with the blade wheel 10 in the axial direction.

Figure 5:
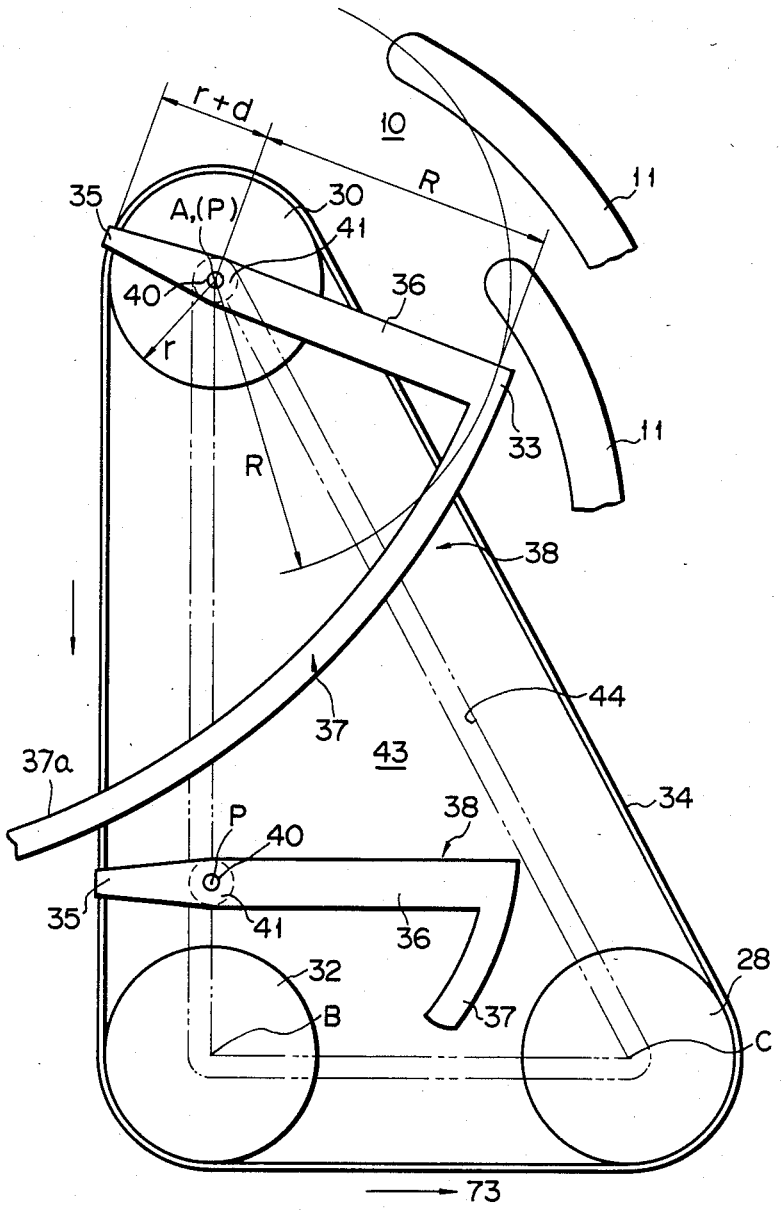
FIG. 5 is a schematic view for explaining the operation of a second blade of the apparatus shown in FIG. 1.

FIG. 5 shows positional relationships among the pulleys 30, 32 and 28, the conveyor belt 34 which travels in the direction indicated by the arrow 73, the dividing member 38, points A, B, C and P, the guide wall 44, and two curved slots 11 (only that portion of the slots in the vicinity of the center of the blade wheel 10). As shown in FIG. 5, the distance between the distal end portion 35 of the dividing member 38 and point P is substantially equal to the distance r+d. The distance between the extending end 33 of the arm 36 and point P is substantially equal to the distance corresponding to the radius R. The guide wall 44 having the guide recess 43 therein so as to guide the dividing member 38 comprises three lines obtained by connecting arcs of three small circles when the bearing 41 fitted over the pin 40 reaches points A, B and C. When viewed toward the direction of FIGS. 1 and 5, the guide wall 44 has a substantially right-angled triangular shape.

The dividing member 38 illustrated in the upper portion of FIG. 5 is positioned at a portion of the conveyor belt 34 which is brought into contact with the periphery of the pulley 30. The dividing member 38 is then rotated about the axis (corresponding to point A) of the pin 40 located coaxially with the pulley 30. The dividing member 38 partially illustrated in the lower portion of FIG. 5 is located at a portion of the conveyor belt 34 at which the distal end portion 35 runs vertically. The arm 36 is oriented in a substantially horizontal direction and is moved vertically.

As shown in FIG. 1, upper and lower conveyor belts 47 and 46 are disposed to supply the paper sheet 50, which travels in the direction indicated by the arrow 70 above the blade wheel 10, to the blade wheel 10. A pulley 45 serves to drive the belt 46 so as to reverse the conveying direction. A pulley 48 serves to drive the conveyor belt 47 so as to reverse the conveying direction. The conveyor belt 46 travels superposed on the conveyor belt 47 from the right-hand direction. The superposed portion of the conveyor belts 46 and 47 on the right-hand side of the pulley 45 serves as a conveying path 49 of the paper sheet. The paper sheet 50 is transferred from the right along the conveying path 49. When the paper sheet passes over the pulley 45, it is discharged from the conveying path 49 and is sequentially received in the curved slot 11 of the blade wheel 10.

A stopper 51 (FIGS. 1 and 2) is disposed between the support plates 3*a* and 3*b* (FIG. 2) to discharge the paper sheet 50 (FIGS. 1 and 3) from the corresponding curved slot 11 of the collecting wheel 10. The stopper 51 obliquely extends from the the lower peripheral portion of the blade wheel 10 toward the upper left when viewed from the direction of FIG. 1. The distal end of the stopper 51 reaches the vicinity of the proximal end of the curved slot 11. With rotation of the blade wheel 10, the stopper 51 is inserted in the curved slot 11 and limits movement of the paper sheet 50 rotated counterclockwise together with the blade wheel 10. The stopper 51 then removes the paper sheet 50 from the curved slot 11.

A conveyor belt 60 is disposed under the blade wheel 10 as shown in FIG. 1. The conveyor belt 60 receives the paper sheet 50 discharged from the curved slot 11. Furthermore, when the predetermined number of paper sheets is piled thereon, the stack of paper sheets is conveyed to a predetermined position by the conveyor belt 60. When a motor 63 mounted on the base plate 1 (FIG. 4) through a proper member (not shown) is driven, the rotational force of the motor 63 is transmitted to a pulley 61 through a shaft 62. Upon rotation of the pulley 61, the conveyor belt 60 is driven in the direction indicated by an arrow 75, so that the stack of a predetermined number of plate sheets placed on the conveyor belt 60 is transferred to the left in FIG. 1.

The paper sheet 50 fed through the conveyor path 49 shown in FIG. 1 is inserted in a curved slot 11 such that the two sides of the paper sheet correspond to inner sides of the curved slots 11*a* and 11*b*, respectively. Since the dividing members 38*a* and 38*b* are disposed outside the blade wheels 10*a* and 10*b*, respectively, the paper sheet discharged from the curved slot 11 is supported on the dividing members 38*a* and 38*b* at two positions located outside the positions at which the paper sheet is supported by the blade wheels 10*a* and 10*b*.

Figure 6:
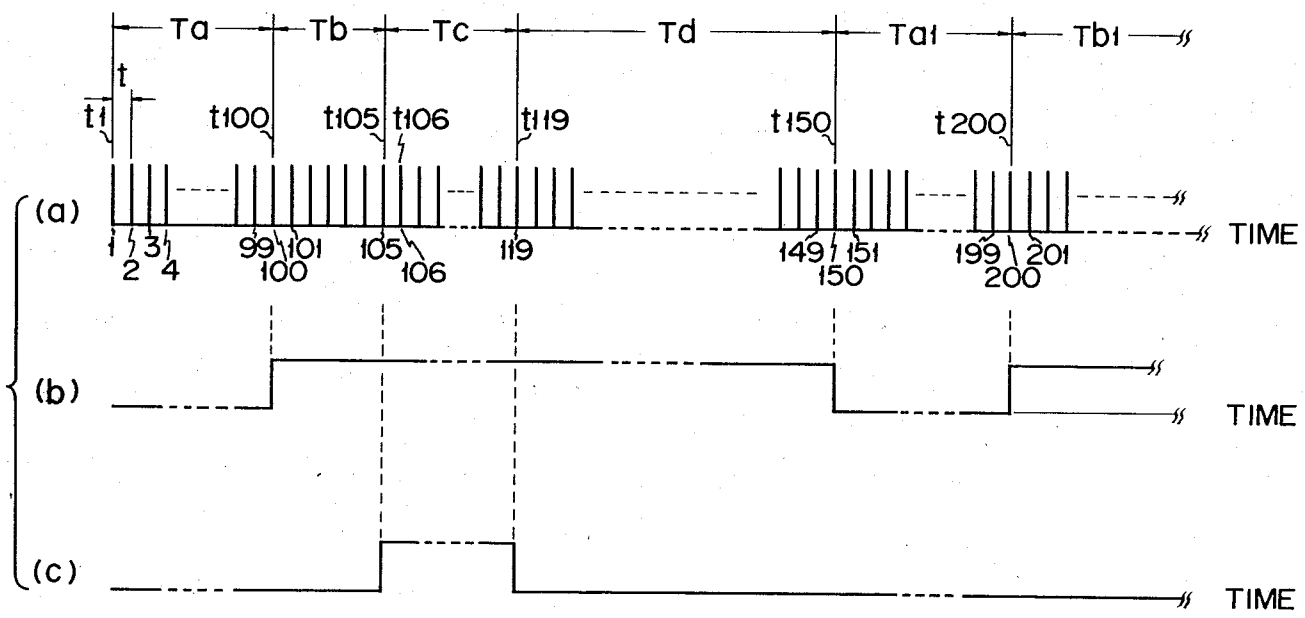
FIG. 6 is a timing chart for explaining the operation of the main part of the apparatus shown in FIG. 1.

The operation of the paper-sheet dividing apparatus having the structure described above will now be described. Twelve first blades 12 are disposed in the blade wheel 10 at equal angular intervals of 30°. Twelve curved slots 11 are thus formed in the blade wheel 10. Referring to FIG. 1, assume that 1200 paper sheets are fed per minute along the conveyor path 49 (i.e., the paper sheets are supplied at intervals of 50 ms). FIG. 6 shows timing charts (a), (b) and (c) wherein time is plotted along the abscissa. The chart (a) indicates a time when the paper sheet 50 is completely inserted in the curved slot 11. This time is indicated by a line segment extending upward from the abscissa. Numerals along the abscissa indicate main line segment numbers. Now assume that paper sheets are supplied to the blade wheel to be divided into stacks of 100. Time $t_1$ in the chart (a) indicates a time when the first paper sheet among the 100 paper sheets is inserted in the corresponding curved slot 11. Time $t_{100}$ indicates a time when the 100th paper sheet is inserted in the corresponding curved slot 11. Reference symbol $T_a$ denotes a time interval from time $t_1$ to $t_{100}$, and $T_b$, a time interval from time $t_{100}$ to $t_{105}$. Other time intervals and times can be inferred from the above description. Reference symbol t at the left of the chart (a) indicates a time interval during which the blade wheel 10 is rotated through 30° (i.e., 50 ms). The above-mentioned speed then indicates that the blade wheel is rotated at a speed of 100 rpm. The blade wheel 10 is rotated by the motor 18 through the shaft 15, the pulley 16, the transmission belt 17, the pulley 14 and the shaft 7 at the above-mentioned speed, as shown in FIGS. 1, 3 and 4.

The timing chart (b) of FIG. 6 indicates the operation of the clutch mechanism 23. The rectangular wave periods between times $t_{100}$ and $t_{150}$ and after a time $t_{200}$ indicate that the clutch mechanism 23 is operated. During these periods, the conveyor belt 34 is driven, and the dividing member 38 is rotated or moved parallel (described later). During any period other than those for which the clutch mechanism 23 is operated, the clutch mechanism 23 is disabled, the conveyor belt 34 is not driven, and the dividing member 38 is stopped at a predetermined stop position to be described later. The paper sheet 50 is delivered from the end of the conveyor path 49 along a line tangent to the periphery of the blade wheel 10 and is sequentially inserted in the curved slot 11 which is passing a space formed in front of the end of the conveying path 49. FIG. 1 illustrates six curved slots 11 in which paper sheets 50 are respectively inserted. The most delayed curved slot 11 corresponds to the position at which the paper sheet is inserted, that is, the paper sheet reception position. Therefore, no paper sheet 50 is inserted into the curved slot 11 which is passing a more delayed position than that of the most delayed curved slot 11. The dividing member 38 located at the stop position is matching along the axial direction with the first blade 12 which is present between the curved slot at the sheet reception position and the next curved slot which is delayed by 30°. Accordingly, when the dividing member 38 is stopped at the stop position, the second blade 37 does not interfere with the insertion of the paper sheet 50 in the curved slot 11.

The timing chart (c) of FIG. 6 indicates the operation of the motor 63 (FIG. 4) for driving the conveyor belt 60 through the pulley 61. The rectangular wave plotted along the abscissa indicates the operating condition of the motor 63. The time at which the motor 63 starts and stops will be described later.

Figure 7A:
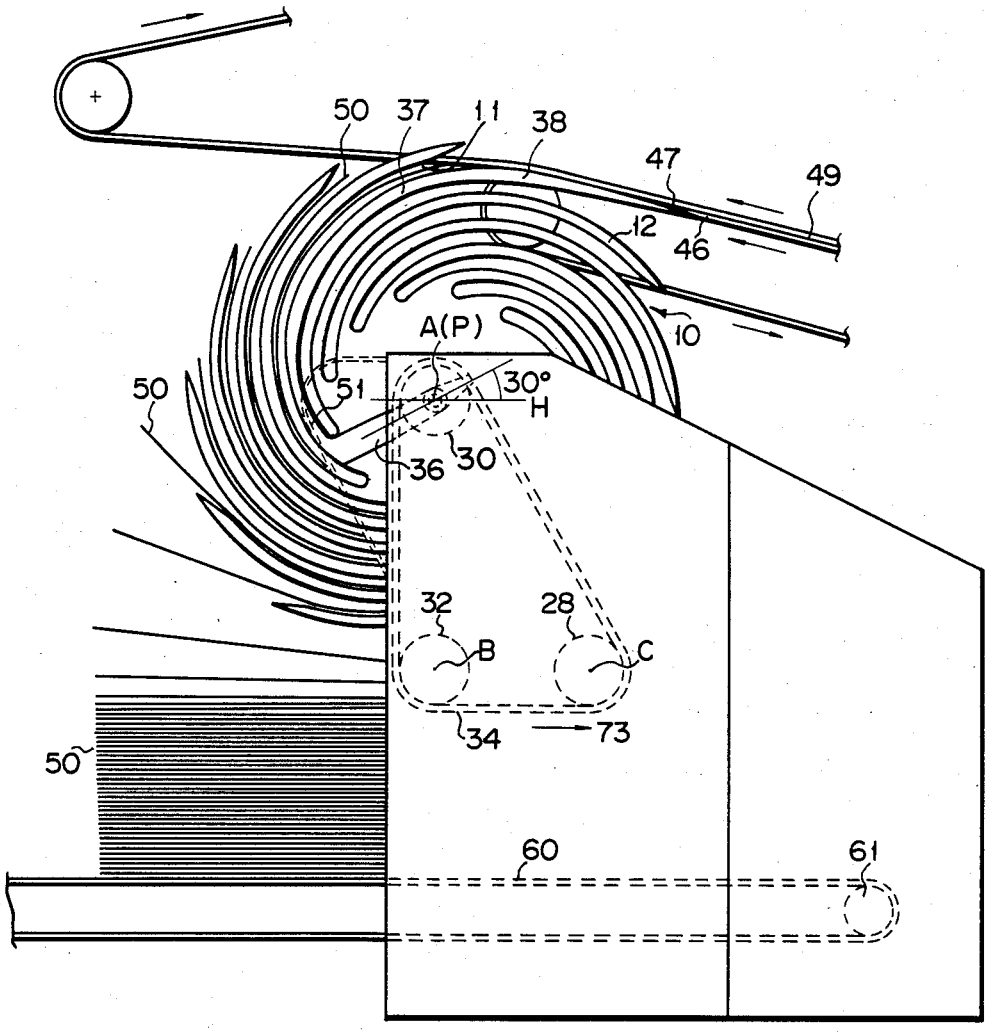

FIG. 7A indicates the state wherein the motor 18 and both conveyor belts 46 and 47 are driven to convey the paper sheet 50 along the conveying path 49, and the paper sheet 50 is then sequentially inserted in the curved slot 11 which is passing the sheet reception position. In this condition, the clutch mechanism 23 is disabled, and the dividing member 38 is set at the stop position described above. Therefore, the paper sheet is smoothly inserted in the corresponding curved slot 11 without the interference of the dividing member 38. The axes of the dividing member 38 and the pin 40 are coaxial with that of the blade wheel 10 and are indicated by point A. Referring to FIG. 7A, the dividing member 38 is stopped at the stop position and the arm 36 is inclined by 30° counterclockwise with respect to the horizontal line passing through point A.

Paper sheets supplied to the blade wheel 10 at a rate of 1200 per minuit are inserted into the corresponding curved slots 11 at a speed higher than that of the peripheral portion of the blade wheel 10. Each paper sheet is inserted in the curved slot 11 of an involute curve and slides between the adjacent first blades 12. A frictional force between the first blades 12 and the paper sheet 50 allows reduction of the speed of the paper sheet 50, and the paper sheet 50 is completely inserted in the curved slot 11. The insertion speed gradually decreases such that by the time the paper sheet 50 abuts against the stopper 51, and the speed of the paper sheet 50 is already substantially zero. Therefore, the leading end of a paper sheet 50 (except for a very soft paper sheet 50) should not be damaged due to abutment between the paper sheet 50 and the stopper 51.

When the blade wheel 10 is rotated counterclockwise, the paper sheet 50 is removed from the corresponding curved slot 11 by the stopper 51. The paper sheet 50 then drops along the side wall 13 of the support plates 3 and is stacked on top of the previous dropped paper sheet 50. This operation continues until 100 paper sheets have been sequentially inserted in the corresponding curved slots 11. FIG. 7A shows a condition during this operation. More particularly, six paper sheets 50 from the 95th to 100th paper sheets are inserted in the corresponding curved slots 11, respectively. Two paper sheets 50 are dropping from the collecting wheel 10, and the previous 92 paper sheets 50 are stacked on the conveyor belt 60. The time interval from the start point to the condition indicated by FIG. 7A corresponds to the time interval $T_a$ in chart (a) in FIG. 6. The time $t_{100}$ indicates the end of the time interval $T_a$.

When the 100th paper sheet is completely inserted in the corresponding slot, the clutch mechanism 23 is driven as indicated by chart (b) in FIG. 6. The shafts 21 and 24 (FIG. 4) are coupled to each other. During this period, the dividing member 38 is kept stopped. The second blade 37 is matched in the axial direction with the first blade 12 positioned between the curved slot which receives the 100th paper sheet and that which receives the 101st paper sheet. Therefore, when the shafts 21 and 24 are coupled to each other, the second blade 37 is rotated counterclockwise together with the first blade 12. The curved slot 11 which is due to receive the 101st paper sheet receives the 101st paper sheet at the sheet reception position. The dividing member 38 is rotated such that the rotational force of the motor 18 is transmitted to the pulley 27 through the transmission belts 20 and 26, the rotational force of the pulley 27 is transmitted to the rotating shaft 9 and the pulley 28 mounted thereon, and the conveyor belt 34 looped around the pulleys 28, 30 and 32 is driven. Since the pulleys 30 and 32 are supported on the shafts 7 and 9 through the bearings 29 and 31, respectively, the shafts 7 and 9 are not driven upon movement of the conveyor belt 34.

Figure 7B:
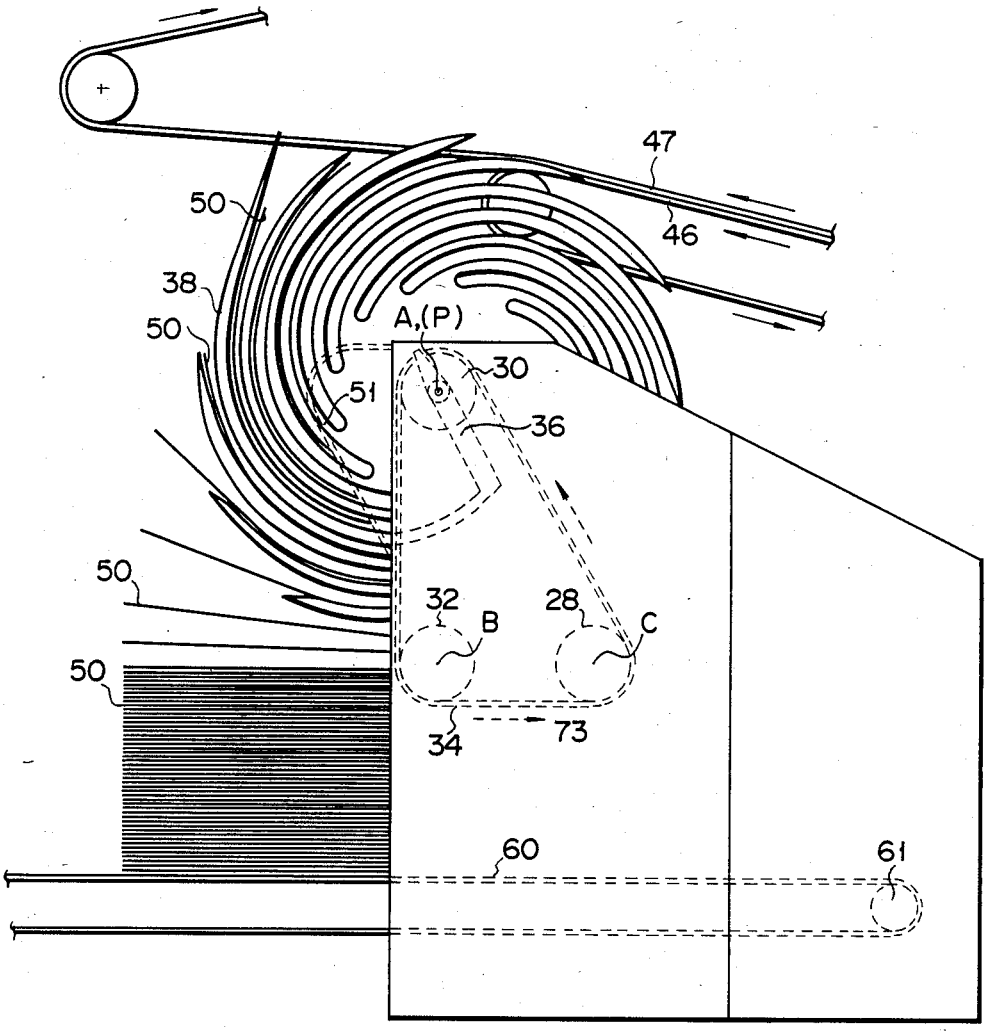

FIG. 7B indicates that the conveyor belt 34 is being driven and the dividing member 38 is being rotated together with the blade wheel 10 from the condition indicated in FIG. 7A. Referring to FIG. 7B, the three paper sheets 50 in the curved slots 11 located preceding the dividing member 38 are being kept therein without suffering the operation of the stopper 51. The remaining 97 paper sheets have been discharged from the blade wheel 10 and have been or are about to be stacked on the conveyor belt 60. Three further paper sheets 50 are respectively inserted in the three curved slots 11 which follow the dividing member 38. These paper sheets 50 are the first three paper sheets of the next 100 paper sheets to be divided.

Figure 7C:
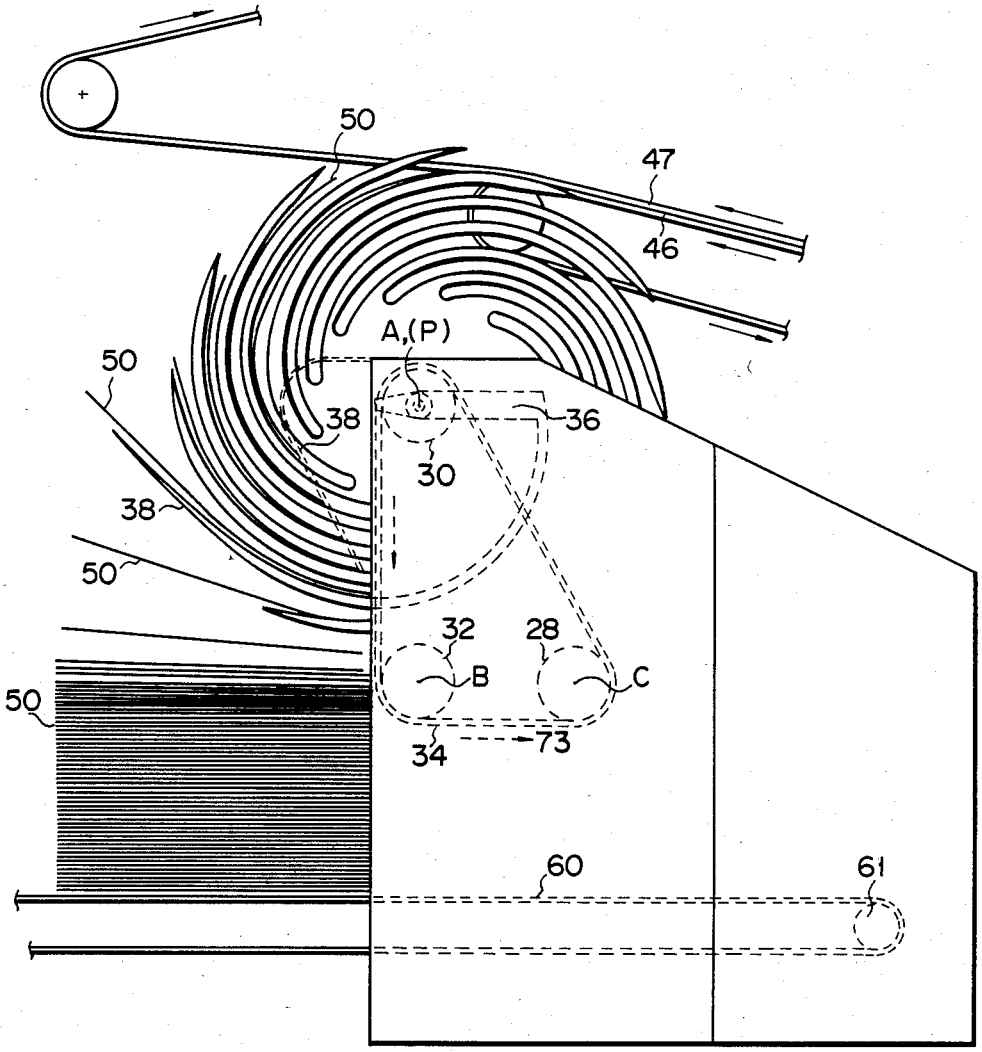

FIG. 7C shows a state wherein the blade wheel 10 and the dividing member 38 are rotated from the state indicated in FIG. 7B, and the arm 36 is orientated to be substantially horizontal. This position of the dividing member 38 is referred as a dividing position. In this position the dividing member 38 acts to divide 100th paper sheet from 101th paper sheet. Referring to FIG. 7C, only one paper sheet 50 is left in the corresponding curved slot 11 which are located preceding the dividing member 38. The previous 99 paper sheets are stacked on the conveyor belt 60. Five further paper sheets are respectively inserted in the curved slots 11 which follow the dividing member 38. In this manner, a time interval from the time $t_{100}$ at which the 100th paper sheet is completely inserted in the corresponding curved slot to the time $t_{105}$ at which the 105th paper sheet is completely inserted in the corresponding curved slot corresponds to the time interval $T_b$ of the timing chart (a) of FIG. 6.

Figure 7D:
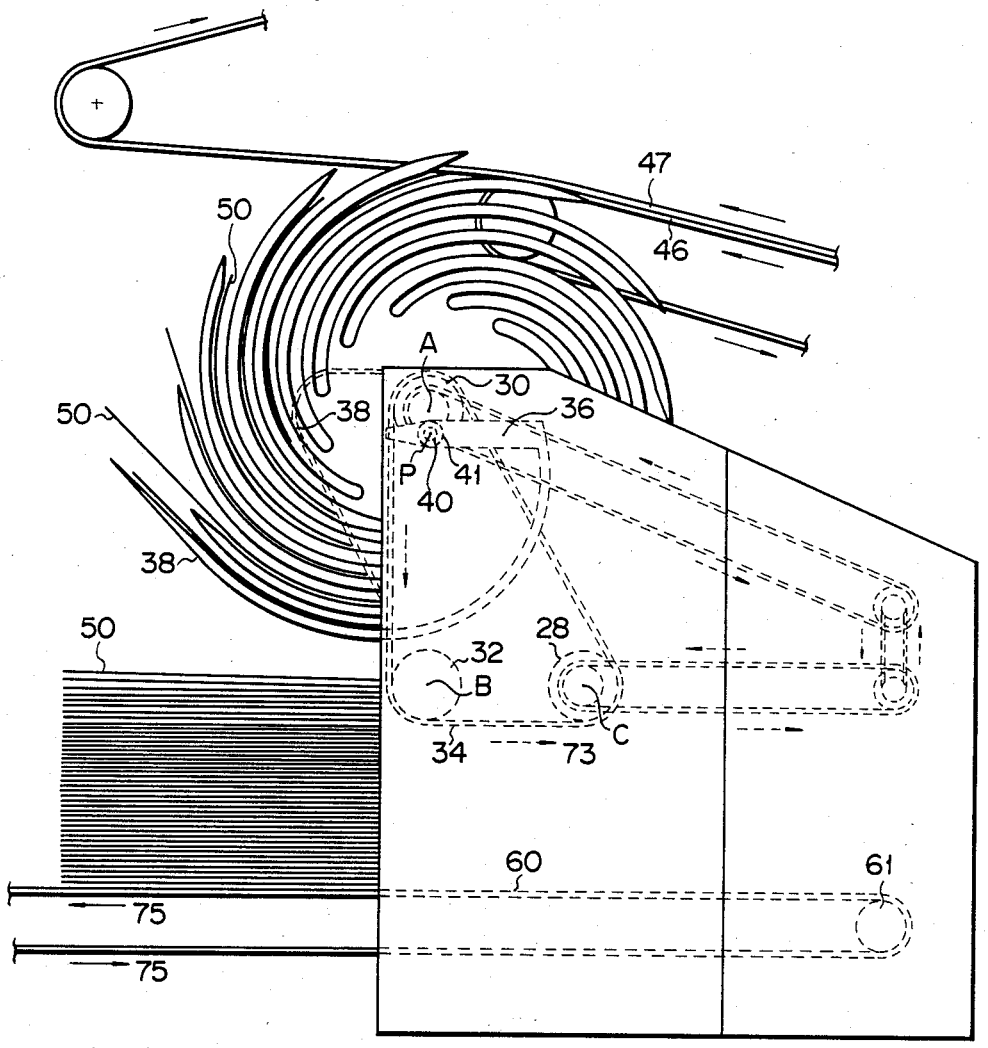

FIG. 7D shows a state wherein the blade wheel 10 is further rotated and the conveyor belt 34 is driven from the state shown in FIG. 7C. Referring to FIG. 7D, the dividing member 38 is moving vertically downward upon movement of the conveyor belt 34. The downward movement of the dividing member 38 is performed such that the bearing 41 fitted over the pin 40 mounted at the dividing member 38 is guided to move along the vertical portion of the right-angled triangular guide wall 44 (FIG. 5), while the arm 36 is oriented substantially horizontal. In the state shown in FIG. 7D, all the paper sheets 50 which have been removed from the curved slots 11 preceding the dividing member 38 are piled on the conveyor belt 60, thus obtaining a stack which comprises 100 paper sheets. Six further paper sheets 50 are inserted in the six curved slots 11 which follow the dividing member 38.

Figure 7E:
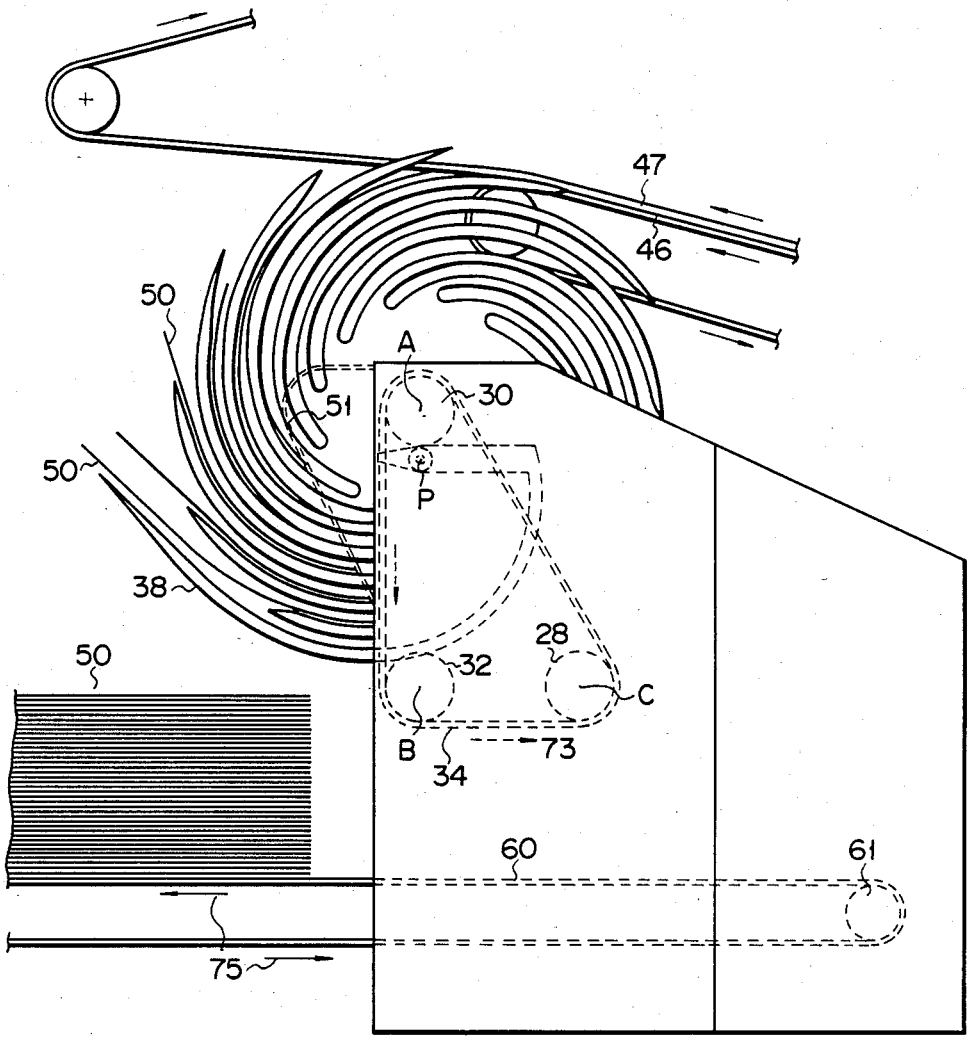

FIG. 7E shows a state wherein the motor 63 began to be (FIG. 4) driven at the time $t_{105}$, so that the stack of paper sheets has been slightly transferred to the left from the position shown in FIG. 7D, and the 106th paper sheet 50 is inserted in the corresponding curved slot 11 at the time $t_{106}$. The chart (c) in FIG. 6 indicates the starting point of the motor 63 at the time $t_{105}$ at which the 105th paper sheet is inserted in the corresponding curved slot 11.

Figure 7F:
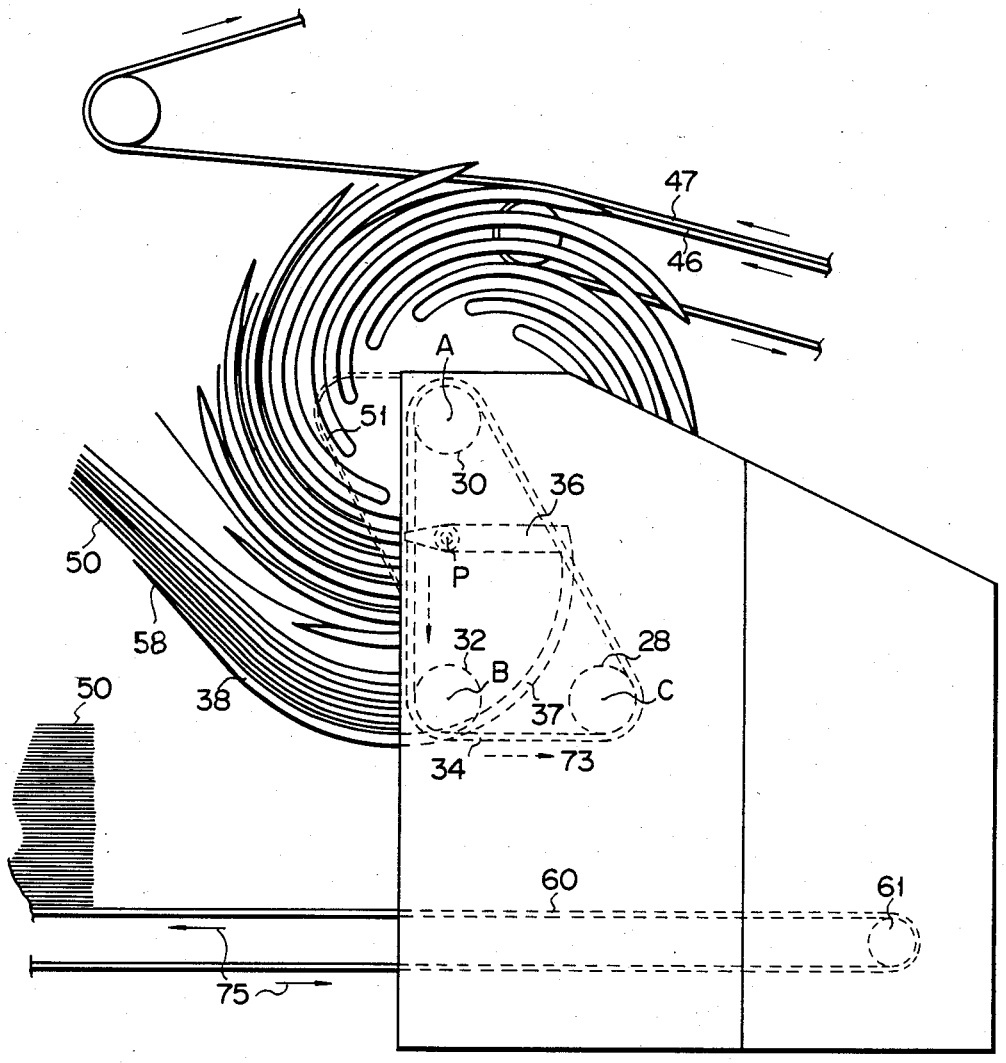

FIG. 7F shows a state wherein the stack of paper sheets further transferred to the left from the position shown in FIG. 7E and no obstacle is therefore present on the conveyor belt 60 so as to prevent the downward movement of the dividing member 38. In this condition, the dividing member 38 is moved further downward from the position indicated in FIG. 7E, and the paper sheets 50 removed from the blade wheel 10 are meanwhile stacked on the second blade 37, and therefore on the dividing member 38. The subsequent paper sheet is sequentially inserted in the curved slot which is passing the sheet reception position. The extending portion 58 as the distal end portion of the dividing member 38 effectively serves to pile the paper sheets 50 stably on the dividing member 38.

Figure 7G:
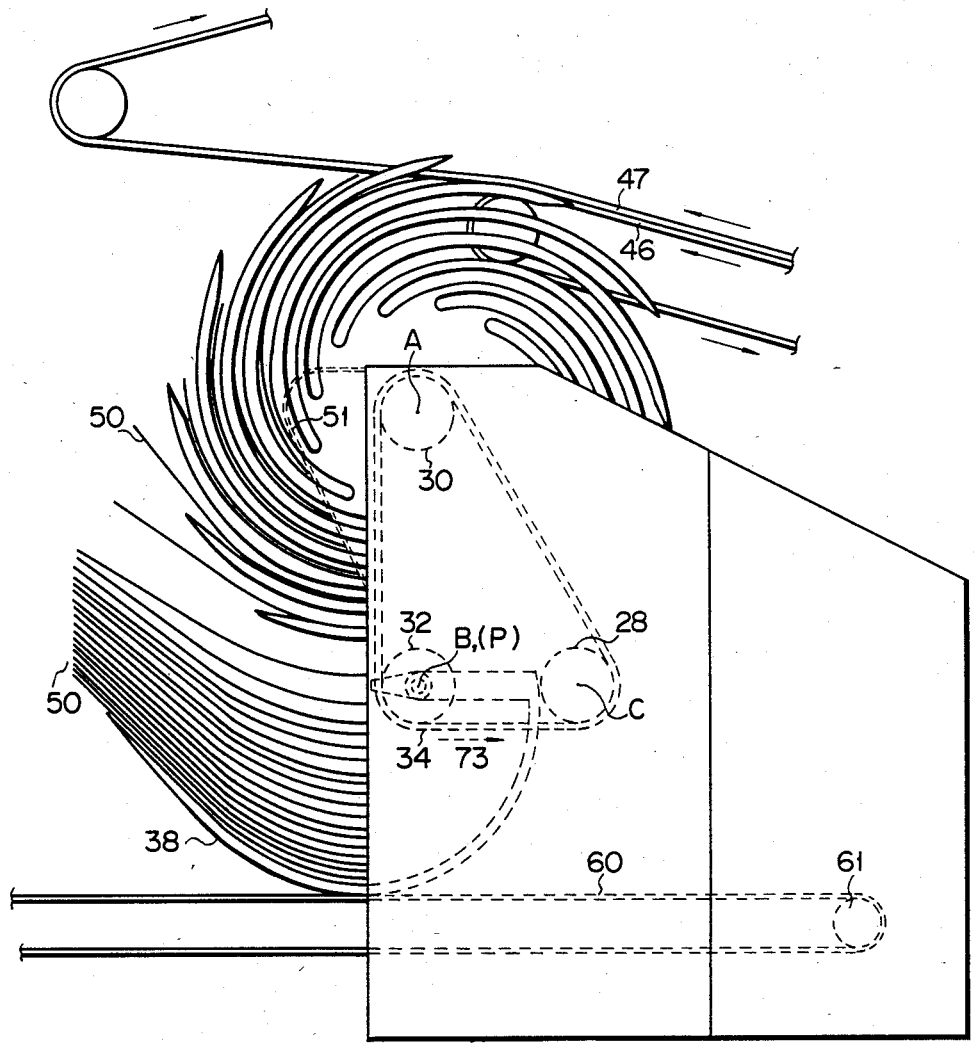

FIG. 7G shows a state wherein the dividing member 38 reaches the lowermost position from the position indicated in FIG. 7F. In this case, the axis (corresponding to point P) of the dividing member 38 is superposed on point B shown in FIG. 5. In FIG. 5 the second blade 37 is shown to be in contact with the conveyor belt 60. However, as shown in FIG. 2, since the conveyor belt 60 is located between the dividing members 38*a* and 38*b*, the dividing member 38 can be rotated about the axis corresponding to point P. The conveyor belt 60 cannot interfere with this rotational movement. The state shown in FIG. 7G corresponds to the time $t_{119}$ of the chart (a) in FIG. 6. The time interval $T_c$ indicates the duration from the time $t_{105}$ to the time $t_{119}$. The paper sheets from the 106th to 119th paper sheets are inserted in the corresponding curved slots 11 during the time interval $T_c$.

Figure 7H:
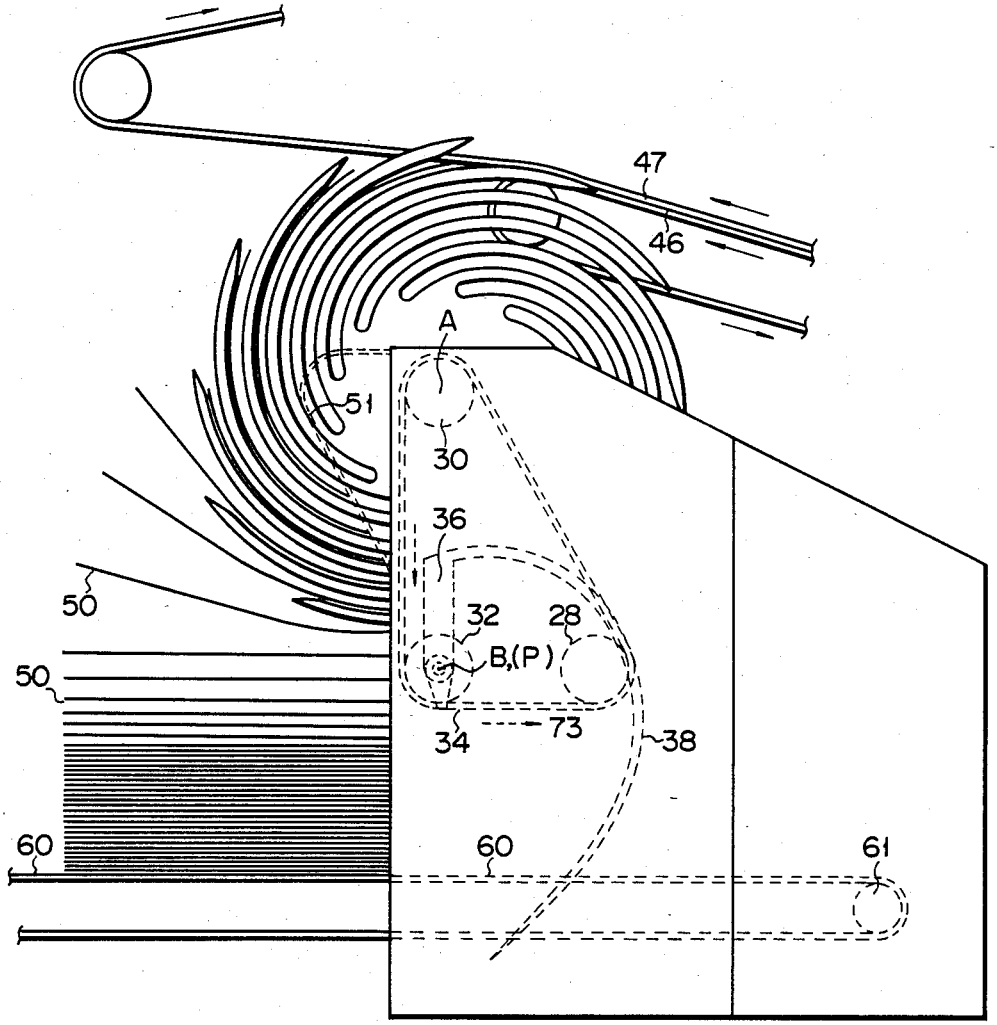
Figure 71:
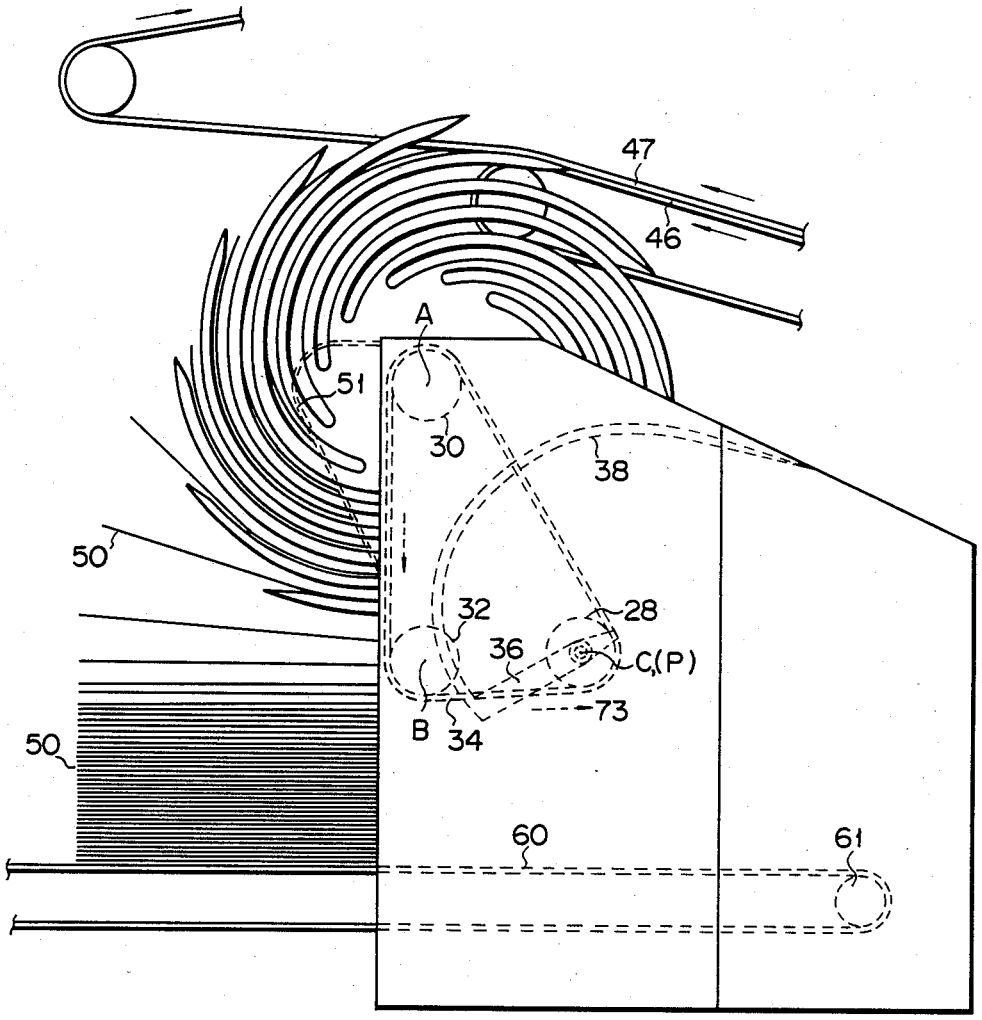

FIG. 7H is a state wherein the dividing member 38 has been rotated through 90° in the counterclockwise direction in accordance with movement of the conveyor belt 34 from the position shown in FIG. 7G. Upon rotation of the dividing member 38, the paper sheets 50 received on the second blade 37 are transferred from the dividing member 38 to the conveyor belt 60 to make a sheet stack. Thereafter, the paper sheets 50 removed from the blade wheel 10 are sequentially put on the obtained sheet stack. At the time indicated in FIG. 7H, the 120th paper sheet 50 is inserted in the corresponding curved slot 11.

FIG. 7I shows a state wherein the dividing member 38 is moved to the right while the arm 36 is vertically oriented as shown in FIG. 7H, and the axis (point P) of the dividing member 38 coincides with point C, and the dividing member 38 has been rotated through about 120° in the counterclockwise direction.

Figure 7J:
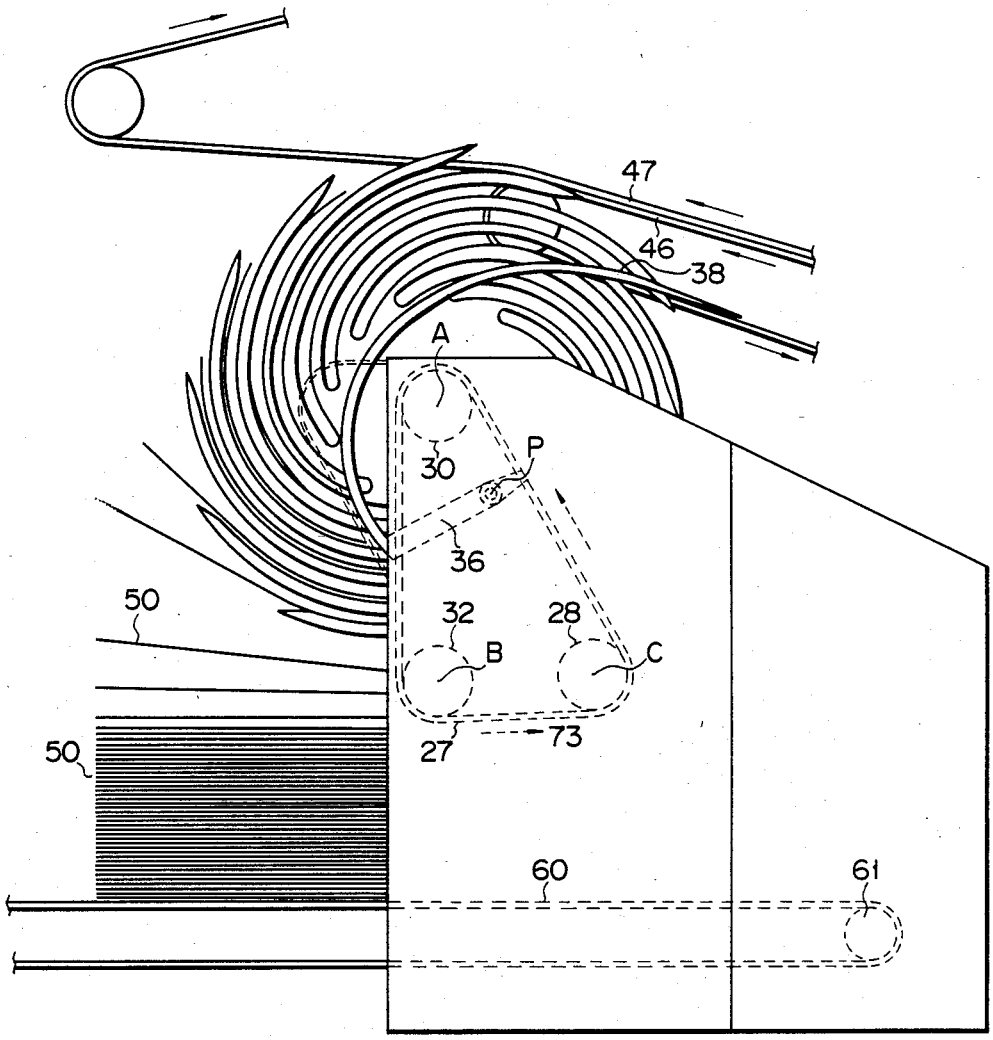

FIG. 7J shows a state wherein the conveyor belt 34 has been further driven from the position shown in FIG. 7I and the dividing member 38 is returning to the position shown in FIG. 7A.

Figure 7K:
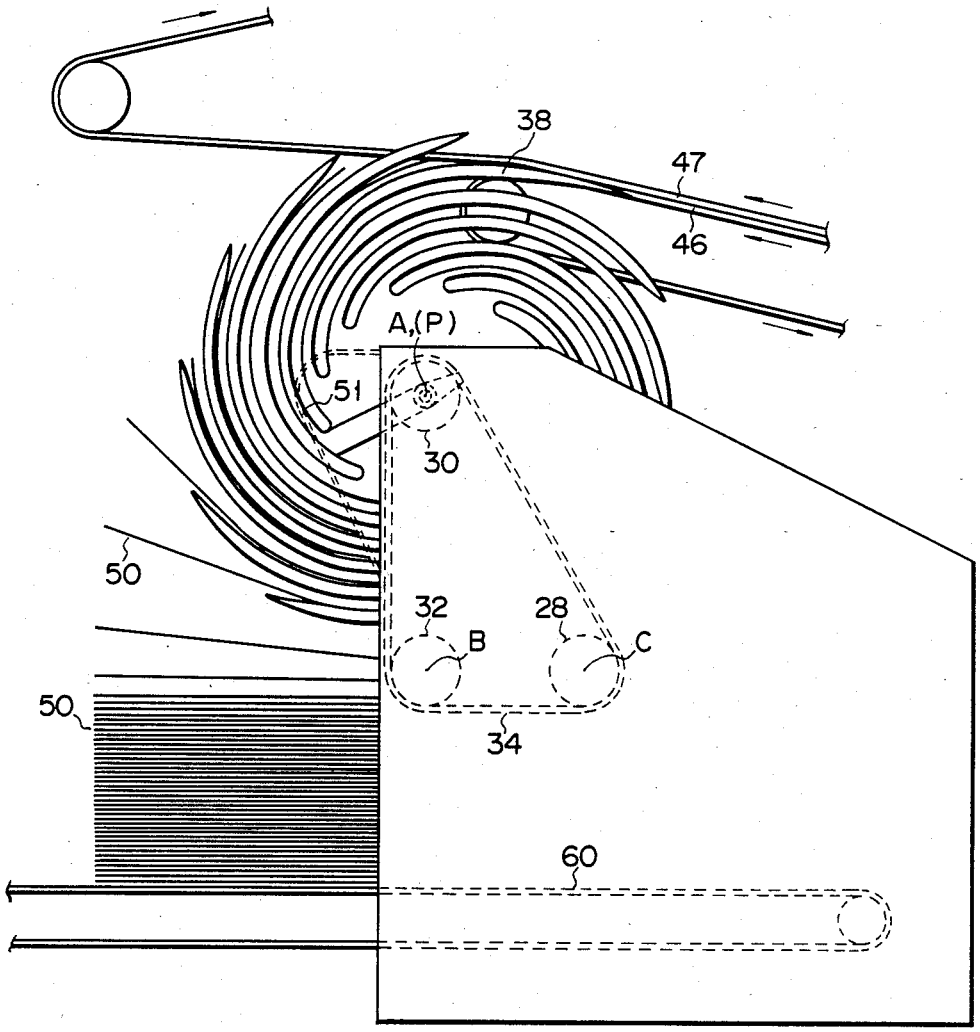

FIG. 7K shows a state wherein the dividing member 38 has completed its linear movement, the axes of the dividing member 38 and blade wheel 10 are superposed on point A, the clutch mechanism 23 is disabled, and the second blade 37 of the dividing member 38 is stopped at the stop position. The state shown in FIG. 7K corresponds to the time at which the 150th paper sheet 50 is inserted in the corresponding curved slot 11 of the blade wheel 10. This time corresponds to the time $t_{150}$ of the chart (a) in FIG. 6. A time interval between the times $t_{119}$ and $t_{150}$ is a time interval $T_d$. At the time $t_{150}$, as shown in the chart (b) in FIG. 6, the clutch mechanism 23 is deenergized, and the dividing member 38 is disabled. However, in this state, the motor 18 is still operated. Therefore, paper sheets 50 continue to be sequentially inserted in the corresponding curved slots 11 which pass the sheet reception position, and the number of paper sheets piled on the conveyor belt 60 increases. When the 200th paper sheet is inserted in the corresponding curved slot 11 and before the 201st paper sheet is inserted in the next curved slot 11, the clutch mechanism 23 is driven as shown in the chart (b) in FIG. 6. Thereafter, the dividing member 38 is rotated to divide the previous 100 paper sheets from the 201st to 300th paper sheets. The operation is the same as that in FIGS. 7A to 7K, and a detailed description thereof will be omitted. Reference symbols $T_{al}$, $t_{200}$ and $T_{bl}$ of chart (a) in FIG. 6 correspond to $T_a$, $t_{100}$ and $T_b$, respectively. As described above, the dividing member 38 is rotated about point C through about 120° from the state in FIG. 7H to the state in FIG. 7I. This is performed to eliminate the drawback that the second blade 37 of the dividing member 38 is brought into contact with the paper sheet 50 rotating in the curved slot so as to disturb the proper movement of the paper sheet 50 and to damage it when the dividing member 38 performs parallel movement in the CA direction and when the distance between points B and C is short.

As may be apparent from the above description, when the conveyor belts 46 and 47, and the blade wheel 10 are driven continuously, and the clutch mechanism 23 and the motor 63 are properly operated, paper sheets continuously supplied are divided into stacks of a fixed number of paper sheets and each stack is sequentially transferred to a predetermined position. During the above-mentioned dividing and transferring operations the blade wheel 10 is rotated continuously. The control system of the motor and the clutch mechanism will be described with the following description of another embodiment of the present invention.

It is noted that the dividing member 38 travels along the loop of conveyor belt 34 and returns to the initial position when predetermined paper sheets (50 in this embodiment) have been fed. In this case, since the paper sheets are divided by every 100 paper sheets, the predetermined number 50 described above may be changed within a range of 100 sheets.

Figure 8:
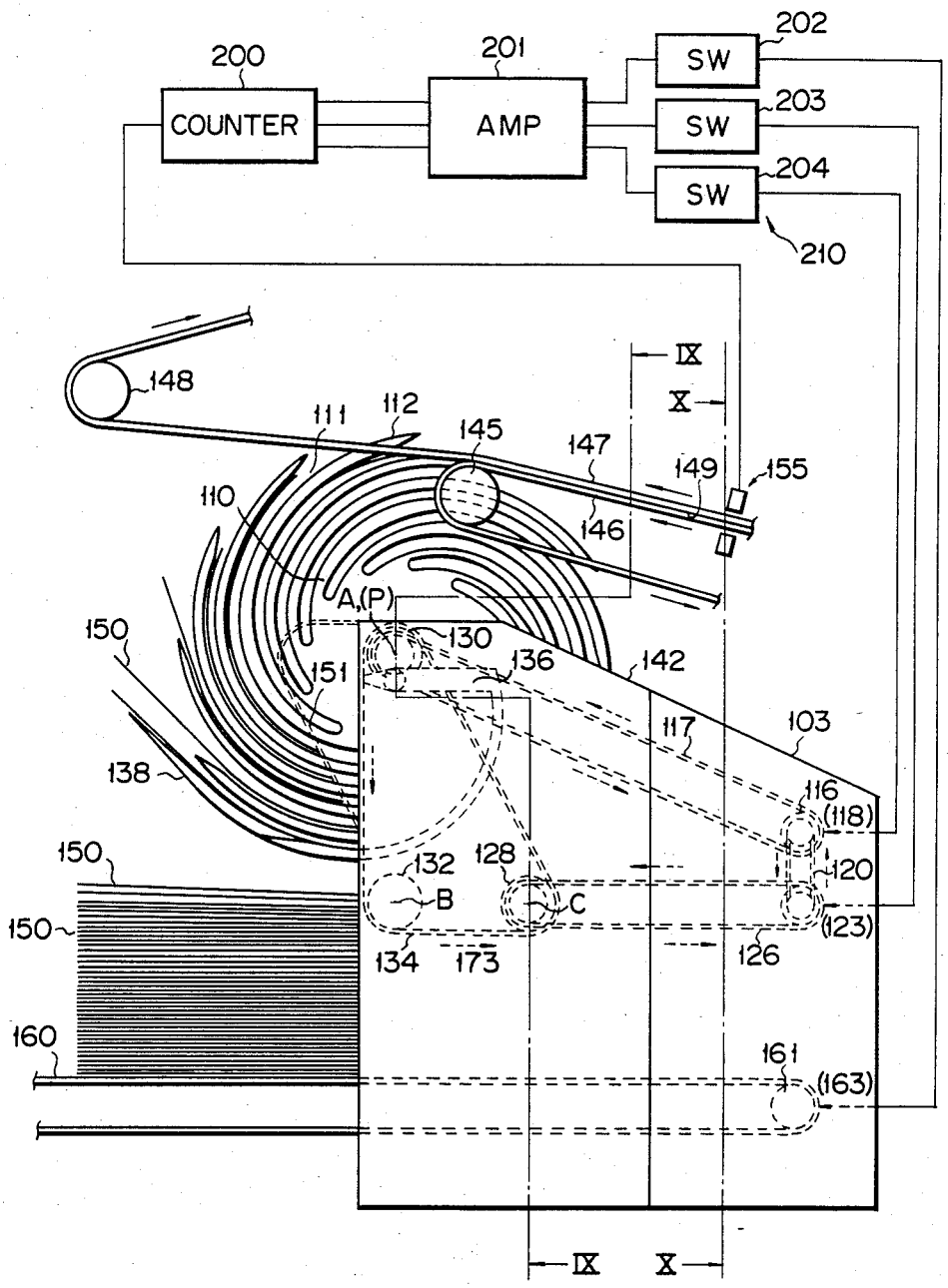
FIG. 8 is a front view of a paper-sheet dividing apparatus according to another embodiment of the present invention.
Figure 9:
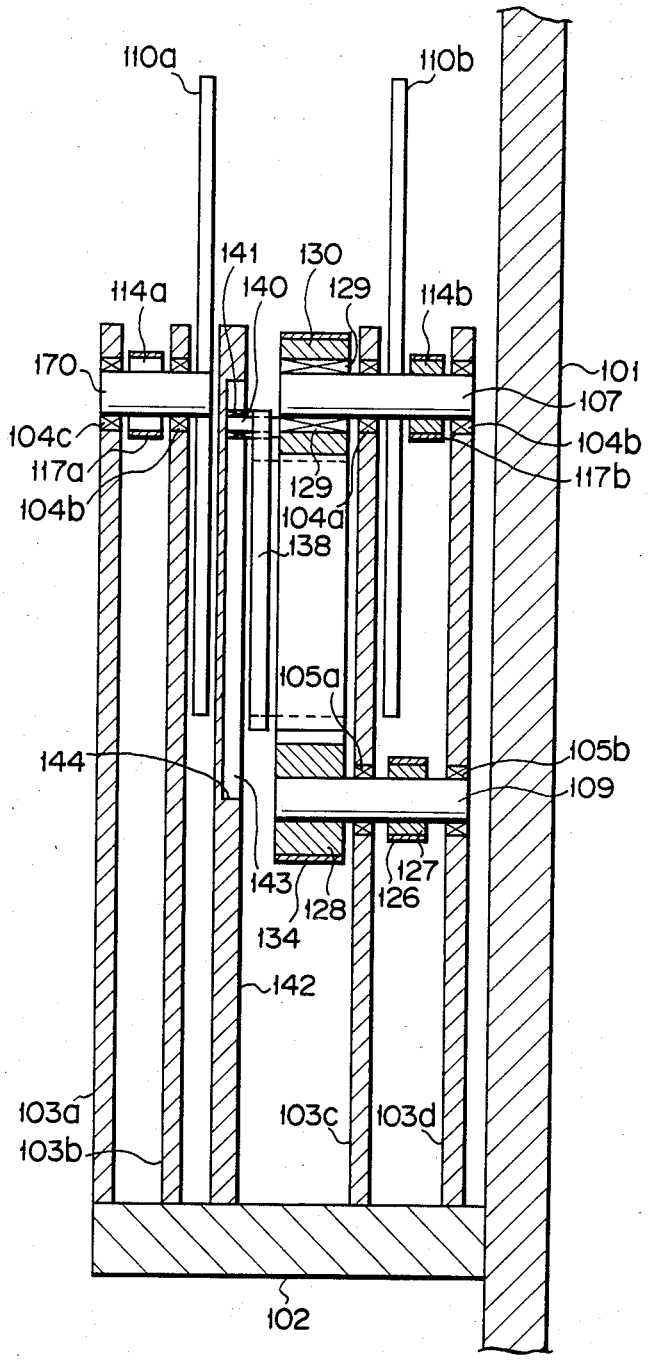
FIG. 9 is a sectional view of the apparatus shown in FIG. 8 taken along the line IX—IX and viewed in the direction of the arrow.
Figure 10:
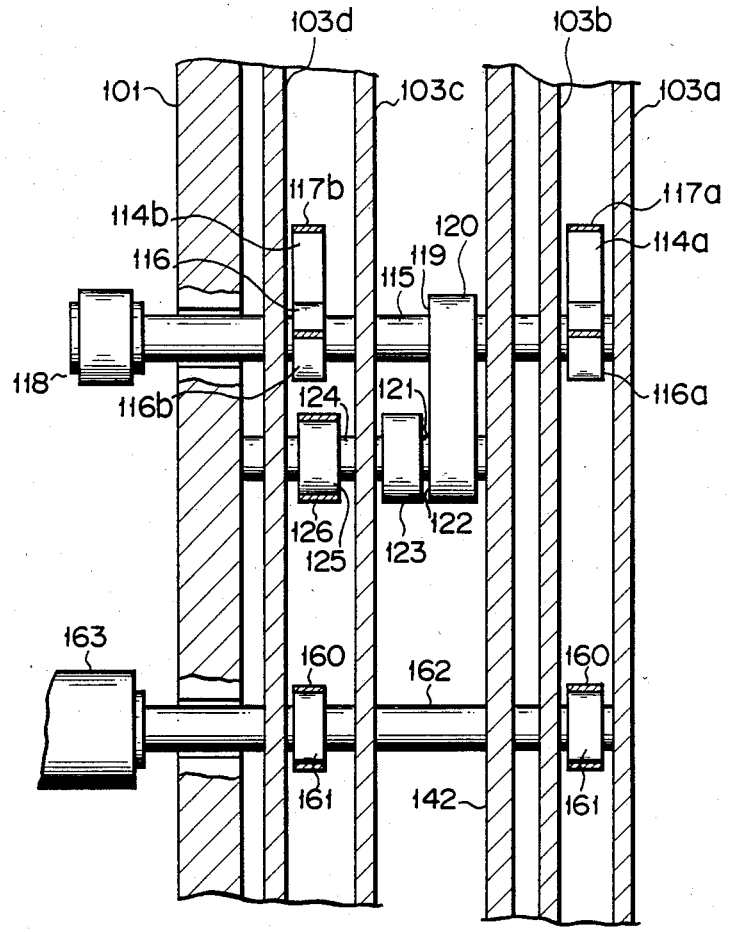
FIG. 10 is a sectional view of the apparatus shown in FIG. 8 taken along the line X—X and viewed in the direction of the arrow.

A paper-sheet dividing apparatus according to a second embodiment of the present invention will now be described with reference to FIGS. 8, 9 and 10. In the first embodiment, the dividing members **38*a* and 38*b* are disposed outside the blade wheels 10*a* and 10*b*, respectively. Dividing members 138*a* and 138*b* are disposed between blade wheels 10*a* and 10*b*. This arrangement of the dividing members 138 allows handling of a narrow paper sheet. The members of the second embodiment are similar to those of the first embodiment and are designated by reference numerals obtained by adding 100 to those used in the first embodiment. FIGS. 8, 9 and 10 correspond to FIGS. 1, 2 and 4, respectively. As shown in FIG. 9, a fixing plate 102 is fixed perpendicularly on a base plate 101. Support plates 103*a*, 103*b*, 103*c* and 103*d* which have substantially the same construction are disposed substantially parallel to the base plate 101. Shafts 107, 108 and 109 are rotatably supported at positions of each of the support plates 103*c* and 103*d*. These positions correspond to points A, B and C in FIG. 5. The shaft 108 is disposed perpendicular to the surface of the drawing at the position B in FIG. 8. However, the shaft 108 is omitted for illustrative convenience. Points A, B and C constitutes substantially a right-angled triangle in the same manner as in FIG. 5. The shaft 107 is supported on the support plates 103*c* and 103*d* respectively through bearings 104*a* and 104*b*. Similarly, the shaft 108 is supported through bearings 106*a* and 106*b*, and the shaft 109 is supported through bearings 105*a* and 105*b*. The bearings 106*a* and 106*b* should be illustrated at the position B in FIG. 8, but are omitted for illustrative convenience. Bearings 104*c* and 104*d* are mounted in the support plates 103*a* and 103*b* and serve to mount a shaft 170 coaxially with the shaft 107 (FIG. 9). A blade wheel 110*a* is mounted on an extending portion of the shaft 170 which extends to the right from the support plate 103*b*. A blade wheel 110*b* is mounted on a portion of the shaft 107 which is sandwiched between the support plates 103*c* and 103*d*. The blade wheel 110 has the same shape as the blade wheel 10 of the first embodiment. More particularly, the blade wheel 110 has twelve first blades 112 and twelve curved slots 111. The curved slots 111 and first blades 112 of the collecting wheels 110*a* and 110*b* are aligned with each other along the axial direction when viewed along the shafts 107 and 170. A pulley 114*a* is mounted on the shaft 170 between the support plates 103*a* and 103*b*. A pulley 114*b* is mounted on the shaft 107 between the support plates 103*c* and 103*d*. As shown in FIG. 10, a shaft 115 coupled to a motor 118 which is then mounted on the base plate 101 through a proper member (not shown) extends through the support plates 103*d*, 103*c* and 103*b* up to the support plate 103*a*. A pulley 116*a* is mounted between the support plates 103*a* and 103*b*, and a pulley 116*b* is mounted between the support plates 103*c* and 103*d*. The pulleys 116*a* and 116*b* are coupled to the pulleys 114*a* and 114*b* through transmission belts 117*a* and 117*b*, respectively. A pulley 119 is mounted on the shaft 115 between a guide plate 142 and the support plate 103*c*. A shaft 124 mounted on the base plate 101 and the guide plate 103*c* is coaxial with a shaft 121 with one end mounted on the guide plate 142. The shafts 124 and 121 are coupled/decoupled by means of a clutch mechanism 123 disposed therebetween. A pulley 122 mounted on the shaft 121 is coupled to the pulley 119 through a transmission belt 120. A pulley 125 is mounted on the shaft 124 between the support plates 103***c* and 103*d*. The pulley 125 is coupled through the transmission belt 126 to a pulley 127 (FIG. 9) mounted on the shaft 109. As shown in FIG. 9, a pulley 128 is mounted on an extending portion of the shaft 109 which extends to the left from the support plate 103*c*. A pulley 130 is mounted through a bearing 129 on an extending portion of the shaft 107 which extends to the left from the support plate 103*c*. The axes of the pulleys 128 and 130 are positioned at points C and A in FIG. 8, respectively. A pulley 132 (FIG. 8) is mounted on a shaft 108 (not shown) between the support plate 103*c* and the guide plate 142. A conveyor belt 134 is looped around the pulleys 132, 130 and 120 in a right-angled triangular shape.

As shown in FIG. 9, a dividing member 138 having the same structure and function as that of the dividing member 38 is mounted on the conveyor belt 134. The dividing member 138 is driven together with the conveyor belt 134 and serves to divide the paper sheets 150 supplied to the blade wheel 110 into groups each including a fixed number of paper sheets. A pin 140 and a bearing 141 which are mounted in the dividing member 138 are guided along a wall 144 of a guide recess 143 so as to circulate the dividing member 138 along a predetermined loop.

Conveyor belts 146 and 147 are disposed at the upper portion of the blade wheel 110 and driven along travelling paths defined by pulleys 145 and 148. The paper sheet 150 to be divided through a conveying path 149 formed between the conveyor belts 146 and 147 is supplied to the blade wheel 110. Detectors 155 are arranged at two sides of the conveying path 149 to count the number of paper sheets 150 passing by. A stopper 151 (FIG. 8) which has substantially the same shape and function as the stopper 51 of the first embodiment is disposed between the guide plate 142 and the support plate 103*c* (FIG. 9).

As shown in FIG. 8, a conveyor belt 160 is disposed under the blade wheel 110 to support a stack including a fixed number of paper sheets 150 discharged from the slots 11 and transfer the sheet stack to a predetermined position at a predetermined time. The conveyor belt 160 is driven by a pulley 161 which is rotated by a motor 163 shown in FIG. 10.

A control circuit for controlling the paper-sheet dividing apparatus shown in FIG. 8 in accordance with a signal from the detector 155 will be described hereinafter. The paper sheets 150 are fed to the blade wheel one by one at fixed time intervals. The blade wheel 110 is driven at a constant speed corresponding to the time intervals. The paper sheets 150 are sequentially inserted in the corresponding curved slots 111. A time lag is present between the time when the detector 155 detects the paper sheet 150 and the time when the same paper sheet 150 is inserted in the corresponding curved slot 111. Although the number of paper sheets actually inserted in the corresponding curved slots is smaller than that detected by the detector 155, the difference between the number of paper sheets actually inserted in the corresponding curved slots and the number of paper sheets detected by the detector 155 is constant. Therefore, when a value corresponding to this difference is subtracted from the value indicated by the signal from the detector 155, the last paper sheet inserted in the curved slot can be calculated. The process for dividing the paper sheets, making stacks and transferring each of the stacks is similar to the two embodiments described above.

A system for controlling the apparatus shown in FIG. 8 will now be described with reference to the timing charts (a), (b) and (c) of FIG. 6, incorporating the detector 155, a counter 200, an amplifier 201, and three switches 202, 203 and 204. The counter 200 counts output signals from the detector 155 and corrects the difference of the paper sheet numbers. As a result, every time the count of the counter 200 reach 100, 105, 119, 150 and 200, the counter 200 produces control signals at times $t_{100}$, $t_{105}$, $t_{119}$, $t_{150}$ and $t_{200}$. Each control signal is amplified by the amplifier 201 to have a proper magnitude, and is then used to drive the switches 202, 203 and 204. The switch 202 is used to energize/deenergize the motor 63 for driving the conveyor belt 160. The switch 203 is used to energize/deenergize the clutch mechanism 123 for starting/terminating the operation of the dividing member 138. The switch 204 is used to energize/deenergize the motor 118 for rotating the blade wheel 110 and the dividing member 138. When the motors 118 and 163 and the clutch mechanism 123 are driven by the three switches 202, 203 and 204 in accordance with the signals from the amplifier 201, units of 100 paper sheets or stacks each divided from the paper sheets supplied to the blade wheel 110 can be transferred to the predetermined position. A motor and a switch for driving the conveyor belts 146 and 147 are not illustrated in FIG. 8. The motor (not shown) may be electrically connected to the switch 204 so as to energize/deenergize it together with the motor 118. The detector 155, the counter 200, the amplifier 201 and the switches 202, 203 and 204 constitute the controlling means for controlling the apparatus of the present invention.

Modifications applied to the apparatuses of the first and second embodiments will now be described in order.

(1) In the above-mentioned embodiments, the second blade 37 extending along an involute curve has a shape in accordance with the shapes of the first blade 12 of the blade wheel 10 and the curved slot 11. These shapes of the first and second blades are useful to decrease the insertion speed of the paper sheet 50 (150) inserted in the curved space 11 (111). If the second blade has a proper shape for this purpose, it may have, for example, an arcuated or cycloidal shape. Furthermore, if the paper sheet is very hard or rigid and will not be damaged even if it strongly abuts against the stopper 51 (151), the first and second blades 12 (112) and 37 (137) may have a linear shape. The width of the first blade 12 may be different from that of the proximal portion 57 of the second blade 37 of the dividing member 38. In brief, for inserting the paper sheet 50 (150) in the curved slot 11 (111) at the sheet reception position, any structure may be used for the dividing member 38 provided that it does not interfere with the insertion operation. The essential feature of such a structure is that the second blade 37 (137), positioned immediately before the slot 11 (111) which is passing the paper sheet reception position is driven to rotate at substantially the same angular velocity as that of the first blade 12 (112), before a paper sheet 50 (150), to be divided arrives at the slot 11 (111). With the second blade 37 (137) moving in the manner described above, the second blade 37 (137), is able to divide the paper sheets 50 (150), supplied to the apparatus without interference from the paper sheets moving into the slot 11.

(2) The dividing member 38 (138) in both the embodiments need not be driven by a belt conveyor means. For example, a combination of a stepping motor and a linear motor, and a chain driving system may be used if such a driving system does not depart from the spirit and scope of the present invention. In brief, it is only necessary that the dividing member 38 (138), can receive and support the first fixed number of paper sheets discharged, and, while supporting them, move toward a transfer means up to a prescribed position to remove the supported paper sheets onto the transfer means.

The movement of the dividing member 38 (138) is not limited to movement along the substantially right-angled triangular path as previously described. For example, after moving to the position indicated in FIG. 7H, the dividing member 38 (138) may be moved upward while maintaining the posture in FIG. 7H to a position at which the axis of it is coaxial with that of the blade wheel 10 (110), instead of moving horizontally as in the above embodiments.

(3) In the above embodiments, the dividing member 38 (138) is rotated to remove the supported paper sheets on the dividing member 38 (138) to the conveyor belt 60 (160). However, the dividing member 38 (138), may be moved downward below the conveyor belt 60 (160) to remove the supported paper sheets thereon.

(4) In the above embodiments, two blade wheels 10*a* (110*a*) and 10*b* (110*b*) and the dividing members 38*a* (138*a*) and 38*b* (138*b*) are used. However, if a wide paper sheet is used, more than two blade wheels 10 (110) and dividing members 38 (138) may be used so as to eliminate unstable transfer of the paper sheet.

(5) In the above embodiments, the blade wheel 10 (110) is made as a single unit. However, it may comprise a disc portion and a plurality of separately manufactured first blades 12 (112) mounted on the periphery of the disc portion.

What is claimed is:

1. A paper-sheet dividing apparatus comprising:

(a) a blade wheel including a rotating shaft and a plurality of first blades each having a paper-sheet receiving surface and extending outwardly from a peripheral vicinity of the rotating shaft;

(b) inserting means for putting each of the paper sheets into a space formed between two adjacent first blades;

(c) means for discharging the paper sheets from the spaces;

(d) stacking means for piling the paper sheets discharged from the spaces;

(e) a second blade having a paper-sheet supporting surface of the same shape as that of the paper-sheet receiving surfaces of the first blades;

(f) supporting means for rotatably supporting the second blade which is substantially coaxial with the first blades at a stop position; and (g) a further means for rotating the second blade at the same rotating speed as that of the first blades from the stop position to a discharging position and thereafter moving the second blade away from the rotating shaft of the blade wheel.

2. An apparatus according to claim 1, wherein said apparatus has two blade wheels positioned coaxially to each other, and corresponding spaces of the blade wheels are aligned with respect to the direction of the axes of the blade wheels.

3. An apparatus according to claim 1, wherein said second blade has substantially the same shape as that of the first blade.

4. An apparatus according to claim 1, wherein until the paper sheets arrive, said second blade is located at a stop position in such a state that a reverse surface of the paper sheet supporting surface of the second blade is positioned immediately before the path which extends from means for supplying paper sheets to the space of the blade wheel.

5. An apparatus according to claim 4, wherein said second blade is fixed at its end to an endless conveyor belt and driven by said conveyor belt.

6. An apparatus according to claim 1, wherein said second blade is moved from the dividing position to the side or right above position of the stacking means for delivering the paper sheets temporarily piled on the second blade onto the stacking means, and then said second blade is driven to return along a predetermined path to the stop position.

7. A paper-sheet dividing apparatus comprising:

(a) a blade wheel including a rotating shaft and a plurality of first blades each having a paper-sheet receiving surface and extending outwardly from a peripheral vicinity of the rotating shaft;

(b) inserting means for putting each of the paper sheets into a space formed between two adjacent first blades;

(c) means for discharging the paper sheets from the spaces;

(d) a second blade having a paper-sheet supporting surface of the same shape as that of the paper-sheet receiving surfaces of the first blades;

(e) supporting means for rotatably supporting the second blade which is substantially coaxial with the first blades at a stop position; and (f) a further means for rotating the second blade at the same rotating speed as that of the first blades from the stop position to a dividing position and thereafter moving the second blade away from the rotating shaft of the blade wheel.

8. An apparatus according to claim 7, wherein said apparatus has two blade wheels positioned coaxially to each other, and corresponding spaces of the blade wheels are aligned with respect to the direction of the axes of the blade wheels.

9. An apparatus according to claim 7, wherein until the paper sheets arrive, said second blade is located at a stop position in such a state that a reverse surface of the paper sheet supporting surface of the second blade is positioned immediately before the path which extends from means for supplying paper sheets to the space of the blade wheel.

10. An apparatus according to claim 9, wherein said second blade is fixed at its end to an endless conveyor belt and driven by said conveyor belt.

11. An apparatus according to claim 7, wherein said second blade is moved from the dividing position to the side or upper right position of the stacking means for delivering the paper sheets temporarily piled on the second blade onto the stacking means, and then said second blade is driven to return along a predetermined path to the stop position.

12. A paper-sheet dividing apparatus comprising:

(a) a blade wheel including a rotating shaft and a plurality of first blades each having a paper-sheet receiving surface and extending arcuately outwardly from a peripheral vicinity of the rotating shaft;

(b) means for carrying the paper sheets in such a manner that each of the paper sheets to be inserted in a space between two adjacent first blades is supplied to the blade wheel in a tangential direction of the outer periphery of the blade wheel and at a higher speed than that of the periphery of the blade wheel and that said paper sheet is decelerated, to stop, by the frictional force generated between the corresponding paper sheet and the first blades;

(c) means for discharging the paper sheets from the spaces, said means being a stationary member located by a side of the blade wheel and extending with a predetermined angle from the outer periphery of the blade wheel to a position corresponding to the end of the spaces;

(d) stacking means for piling the paper sheets discharged from the spaces and dropped onto said stacking means;

(e) a second blade having a paper-sheet supporting surface of the same shape as that of the paper-sheet receiving surfaces of the first blades;

(f) supporting means for rotatably supporting the second blade which is substantially coaxial with the first blades at a stop position; and (g) a further means for rotating the second blade at the same rotating speed as that of the first blades from the stop position to a divided position and thereafter moving the second blade away from the rotating shaft of the blade wheel.

13. An apparatus according to claim 12, wherein said apparatus has two blade wheels positioned coaxially to each other, and corresponding spaces of the blade wheels are aligned with respect to the direction of the axes of the blade wheels.

14. An apparatus according to claim 12, wherein until the paper sheets arrive, said second blade is located at a stop position in such a state that a reverse surface of the paper sheet supporting surface of the second blade is positioned immediately before the path which extends from means for supplying paper sheets to the space of the blade wheel.

15. An apparatus according to claim 14, wherein said second blade is fixed at its end an endless conveyor belt and driven by said conveyor belt.

16. An apparatus according to claim 12, wherein said second blade is moved from the dividing position to the side or upper right position of the stacking means for delivering the paper sheets temporarily piled on the second blade onto the stacking means, and then said second blade is driven to return along a predetermined path to the stop position.

* * * * *